US012458857B1

(12) United States Patent
Ellis Marbet

(10) Patent No.: US 12,458,857 B1
(45) Date of Patent: Nov. 4, 2025

(54) DOUBLE FIRST BASE ANCHOR

(71) Applicant: Line to Line LLC, Columbia, TN (US)

(72) Inventor: William Ellis Marbet, Columbia, TN (US)

(73) Assignee: Line To Line LLC, Columbia, TN (US)

( * ) Notice: Subject to any disclaimer, the term of this patent is extended or adjusted under 35 U.S.C. 154(b) by 0 days.

(21) Appl. No.: 19/032,818

(22) Filed: Jan. 21, 2025

(51) Int. Cl.
*A63B 71/00* (2006.01)
*A63B 69/00* (2006.01)

(52) U.S. Cl.
CPC ..... *A63B 69/0013* (2013.01)

(58) Field of Classification Search
CPC ..... A63B 69/0013
USPC ..... 473/499
See application file for complete search history.

(56) References Cited

U.S. PATENT DOCUMENTS 4,327,914 A * 5/1982 Dowell ..... A63F 3/00031 273/284
4,398,714 A * 8/1983 Fuller ..... A63B 69/0013 473/499
4,493,486 A * 1/1985 Fuller ..... A63B 69/0013 473/499
4,881,735 A * 11/1989 Orsatti ..... A63B 69/0013 473/499
5,000,448 A * 3/1991 Anderson ..... A63B 69/0013 473/501
5,827,140 A * 10/1998 Bartoli ..... A63B 69/0002 473/497
6,422,872 B1 * 7/2002 Outlaw ..... A63B 69/0002 473/270
6,692,257 B1 * 2/2004 Branum ..... A63B 69/0002 472/117
9,272,196 B2 * 3/2016 Kropff ..... A63B 69/0013 473/497
12,280,303 B2 * 4/2025 Clark ..... A63B 69/0013 473/497
2007/0123375 A1 * 5/2007 Mescher ..... A63B 69/0013 473/499
2008/0305897 A1 * 12/2008 Hall ..... A63B 69/0013 473/501

* cited by examiner

*Primary Examiner* — Mitra Aryanpour
(74) *Attorney, Agent, or Firm* — Holland & Knight LLP; Matthew C. Cox; Forrest S. Tinnin

(57) ABSTRACT

The present disclosure provides an apparatus for adapting a first base to a double first base having a fielder base and a runner base. The apparatus may include a first plate. The first plate may define a top face, a bottom face, a first side, and a second side. The first plate may include an anchor aperture defined on the first side. The anchor aperture may be shaped to receive a ground anchor of a fielder base. The second side may be configured to be secured to a runner base. The first plate may further include one or more teeth protruding from the bottom face on the second side. The anchor aperture may be shaped such that the first plate mechanically engages and resists angular movement of the ground anchor relative to the first plate.

25 Claims, 25 Drawing Sheets

DOUBLE FIRST BASE ANCHOR

CROSS-REFERENCES TO RELATED APPLICATIONS

Not applicable.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND

The present disclosure relates generally to baseball and/or softball equipment. More particularly, the present disclosure relates to apparatuses and methods for adapting a first base to a double first base having a fielder base and a runner base.

In baseball and softball, collisions between players of opposing teams happen with frequency at first base. For instance, a batter may be running at full speed towards the first base, and the first baseman may have a foot planted on the first base, waiting for a teammate to throw the ball to the first baseman in time to tag the runner out. Due to one player maintaining position on the first base and a batter running at full speed to reach the first base as fast as possible, such collisions may produce risk of injury.

In order to reduce such injuries, various athletic organizations have proposed modifying the first base to include two side-by-side bases; a fielder base and a runner base, such that the chances of collisions are reduced. However, first bases are often anchored into the ground. It is desirable that runner bases be similarly anchored to the ground. Anchoring a base to the ground requires costly measures such as digging and adding a concrete base into the ground, such that an ground anchor fixed to the base may be inserted within an anchor receiver fixed amongst the concrete below.

Typical workarounds to the costly measure of anchoring the runner base to the ground include providing an elongate base that includes a fielder base portion and a runner base portion. The fielder base portion in such workarounds may include the aforementioned ground anchor for anchoring the elongate base to the ground. Nonetheless, such approaches present the problem that when the batter steps on the runner base at full speed, a torsional force is applied to the elongate base, causing the elongate base to bend or shift in response.

It would be advantageous to provide apparatuses and methods for adapting a first base to a double first base having a fielder base and a runner base, where such apparatuses and methods avoid the aforementioned issues discussed above, including the deficiencies in typical workarounds.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present disclosure is an apparatus for adapting a first base to a double first base having a fielder base and a runner base. The apparatus may include a first plate defining a top face, a bottom face, a first side, and a second side. The first plate may include an anchor aperture defined on the first side. The anchor aperture may be shaped to receive a ground anchor of a fielder base. The second side may be configured to be secured to a runner base. In some embodiments, the apparatus further includes a second plate. The second plate may be disposed above the first plate and be secured to the second side of the first plate. The second plate may be configured to be secured to the runner base.

The anchor aperture may be shaped such that the first plate mechanically engages and resists angular movement of the ground anchor relative to the first plate. In some embodiments, the first plate and, when implemented, the second plate, include one or more connection apertures. For example, such connection apertures may be defined on the second side of the first plate. Such connection apertures may be configured to receive one or more corresponding fastening members, which may be configured to mechanically engage the runner base.

In some embodiments, the first plate further includes additional connection apertures. Such connection apertures may be configured to receive additional corresponding fastening members, which may be configured to mechanically engage the fielder base. In some embodiments, the first plate further includes one or more teeth protruding from the bottom face on the second side.

Another aspect of the present disclosure is a method of adapting a first base to a double first base having a fielder base and a runner base. The method may include providing the aforementioned first plate, securing the runner base to the second side of the first plate, advancing the ground anchor of the fielder base through the anchor aperture of the first plate, and inserting the ground anchor into a ground surface. In some embodiments, securing the runner base to the second side of the first plate includes securing the second plate to the second side of the first plate, and securing the second plate to the runner base.

Another aspect of the present disclosure includes an adapter plate for attachment to an existing anchor post on a primary base on a sports field. The adapter plate may attach to an existing anchor post by inserting the anchor post from the primary base through a slot or opening defined in the adapter plate, wherein the slot is shaped with the same cross-sectional profile as the anchor post. A secondary base may be attached to the adapter plate, thereby securing the secondary base to the primary base via the adapter plate. The adapter plate may be used to attach a secondary base to any of a first base, a second base, a third base or a home base in a sports field.

Numerous other objects, advantages and features of the present disclosure will be readily apparent to those of skill in the art upon a review of the following drawings and description of a preferred embodiment.

DETAILED DESCRIPTION

Figure 1:
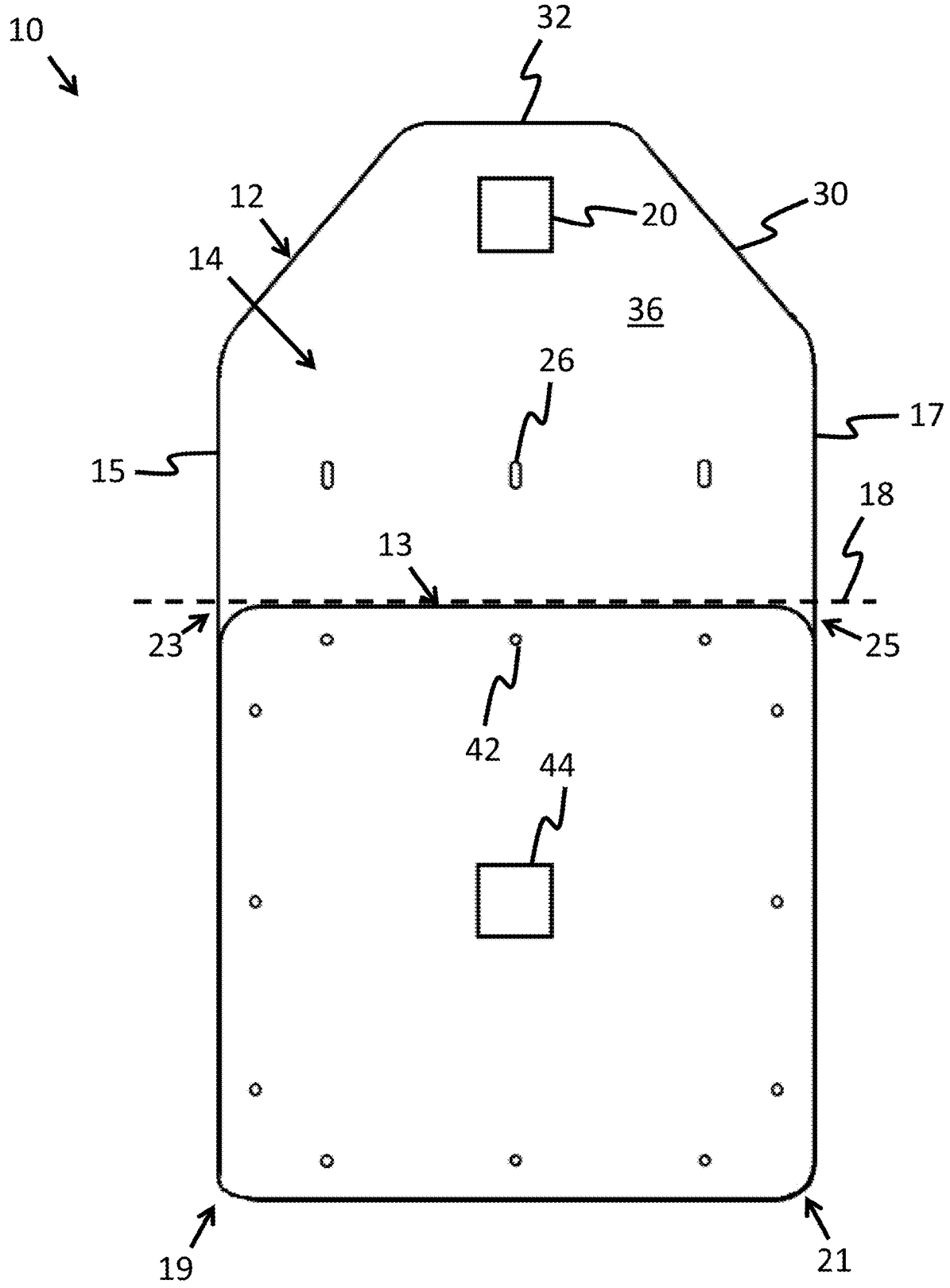
FIG. 1 is a top view of an apparatus for adapting a first base to a double first base having a fielder base and a runner base, according to some embodiments of the present disclosure.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

The present disclosure provides for an apparatus 10. As discussed herein, the apparatus 10 may be configured for adapting a first base to a double first-base having a fielder base 70 and a runner base 50. Accordingly, the apparatus 10 may provide for a secure retrofitting of a conventional first base with the runner base 50 (such that the aforementioned first base may thus be considered the fielder base 70), suitable for adapting baseball fields for compliance with sporting regulations requiring a double first base (e.g., a first base including the fielder base 70 and the runner base 50).

Figure 2:
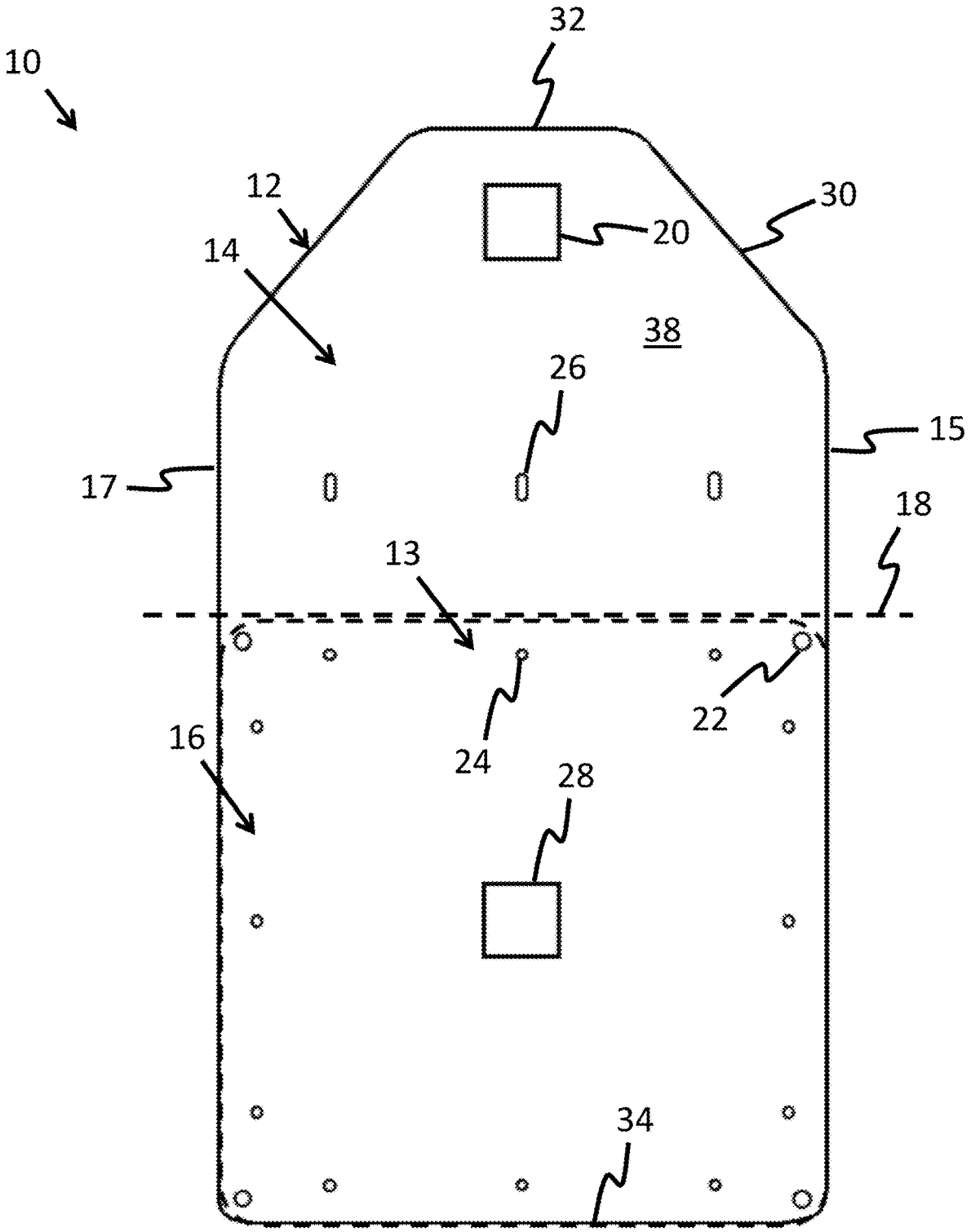
FIG. 2 is a bottom view of an apparatus for adapting a first base to a double first base having a fielder base and a runner base, according to some embodiments of the present disclosure.

Referring now to FIGS. 1 and 2, the apparatus 10 is shown, according to some embodiments of the present disclosure. FIG. 1 depicts a top view of the apparatus 10, and FIG. 2 depicts a bottom view of the apparatus 10.

The apparatus 10 may include a first plate 12. The first plate 12 may include a top face 36, a bottom face 38, a first side 14, and a second side 16. The first plate 12 may include an anchor aperture 20 defined on the first side 14. As shown with additional reference to FIG. 21, the anchor aperture 20 may be shaped to receive a ground anchor 72 of the fielder base 70. As shown with additional reference to FIG. 16, the second side 16 may be configured to be secured to the runner base 50.

In some embodiments, the apparatus 10 further includes a second plate 13. The second plate 13 may be disposed above the first plate 12. In further embodiments, the apparatus 10 further includes the runner base 50 disposed above and secured to the second side 16 of the first plate 12.

Figure 3:
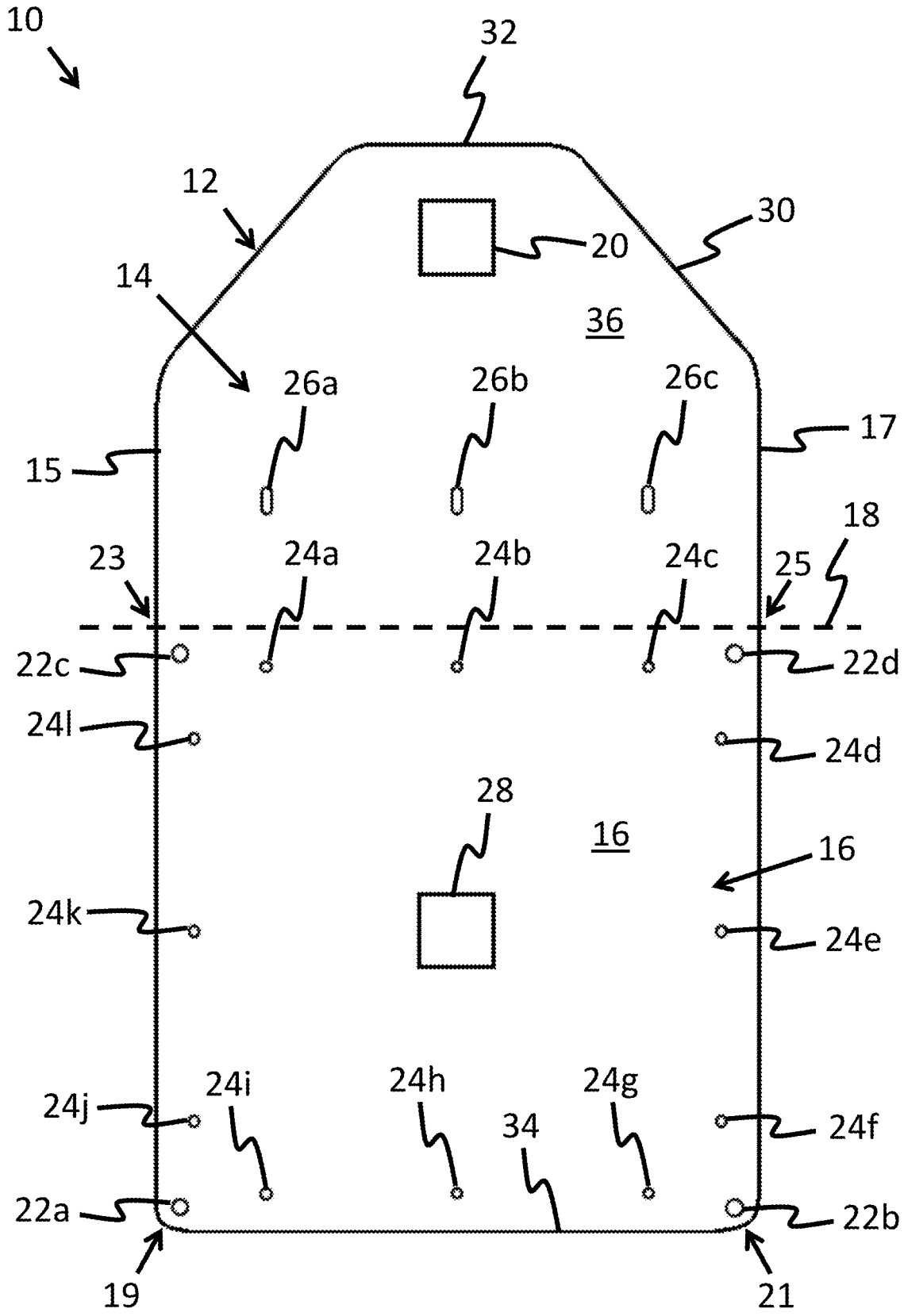
FIG. 3 is a top view of a first plate of the apparatus of FIG. 1, according to some embodiments of the present disclosure.
Figure 4:
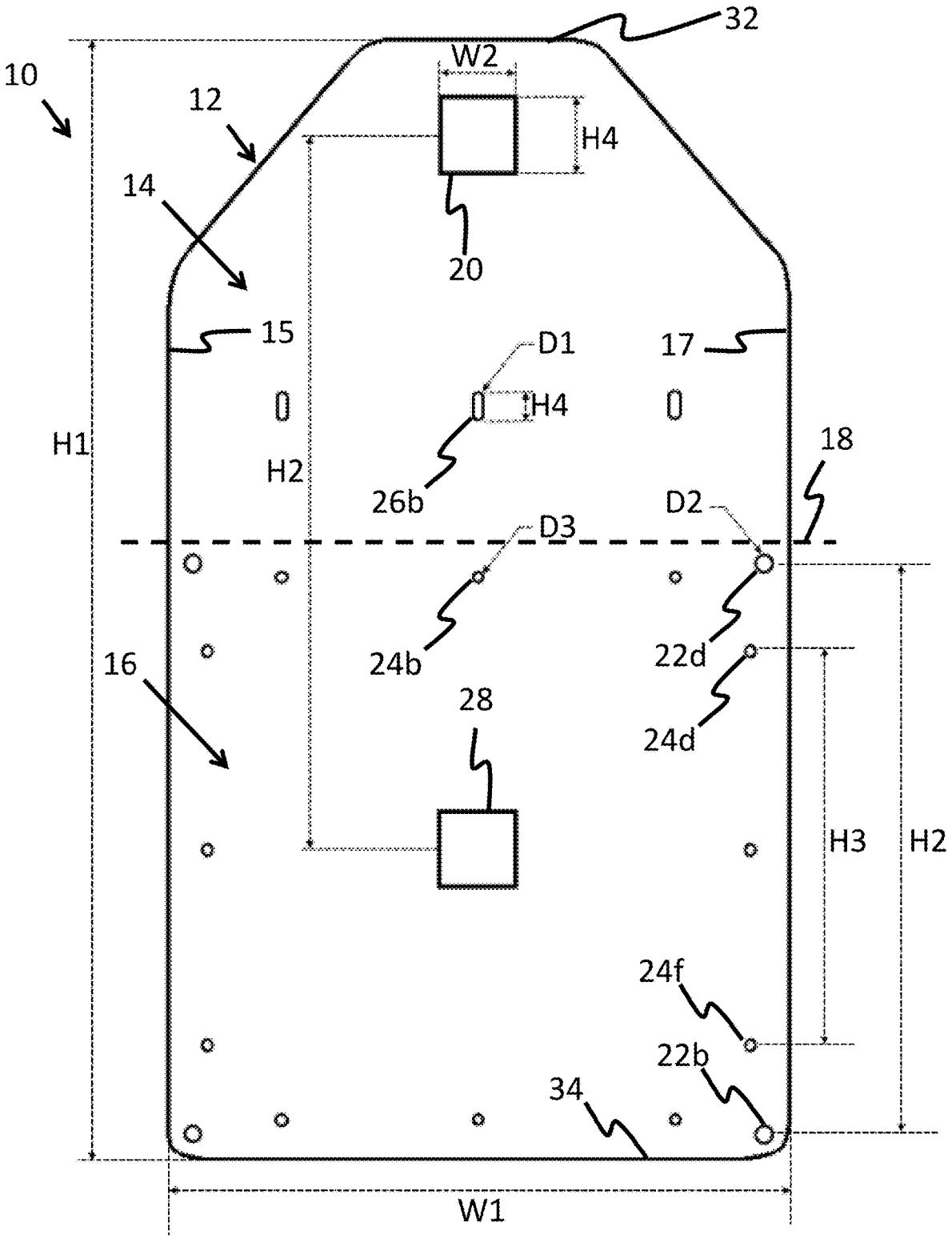
FIG. 4 is a top view of a first plate of the apparatus of FIG. 1, according to other embodiments of the present disclosure.
Figure 5:
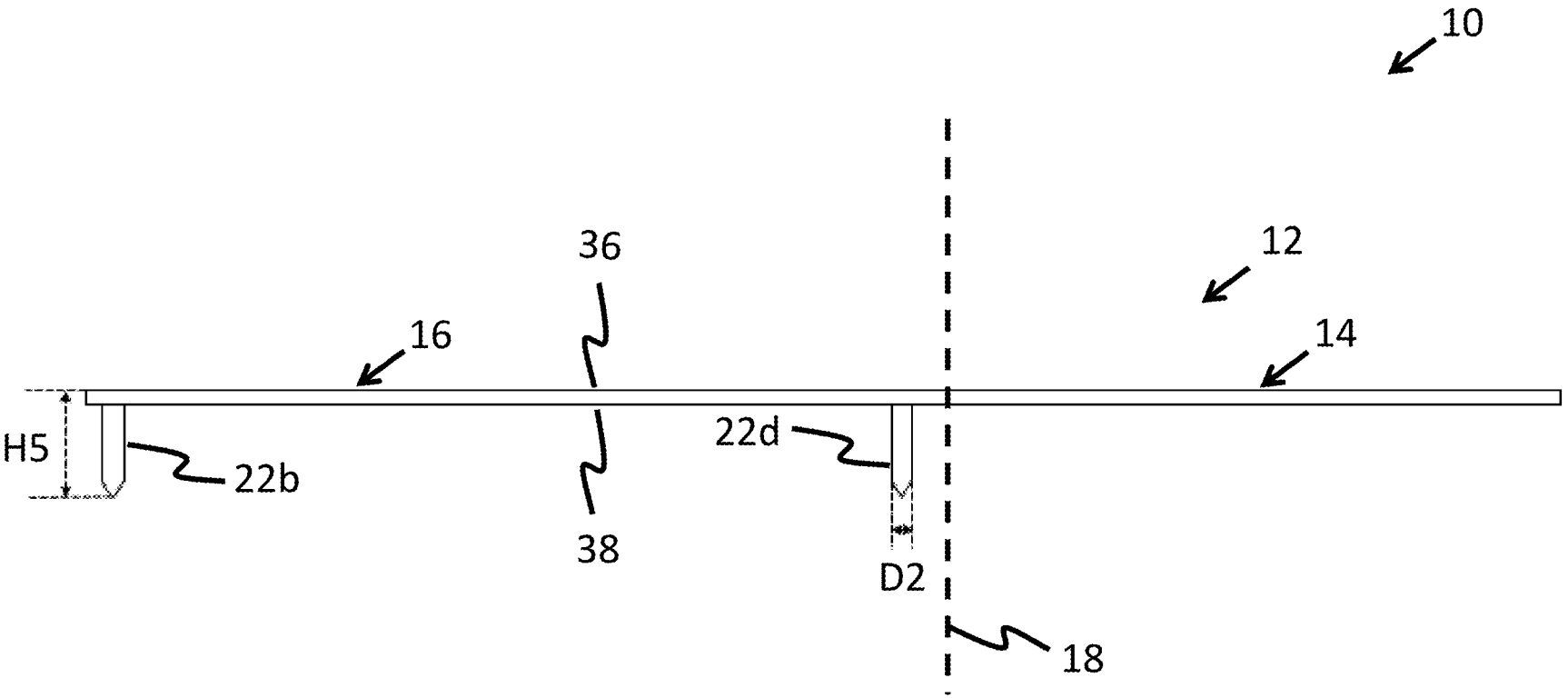
FIG. 5 is a side view of a first plate of the apparatus of FIG. 1, according to some embodiments of the present disclosure.

Referring now to FIGS. 3-5, the first plate 12 is shown in greater detail, according to some embodiments of the present disclosure. FIGS. 3 and 4 depict a top view of the first plate 12, and FIG. 5 depicts a side view of the first plate 12.

The first plate 12 may be a flat (or substantially flat) plate. Accordingly, the first plate 12 may define the top face 36 and the bottom face 38 opposite the top face 26. In some embodiments, the first plate 12 defines an elongate body. Accordingly, the first plate 12 may further define the first side 14 (e.g., a first longitudinal side), a midline 18, and the second side 16 (e.g., a second longitudinal side) opposite the first side 14 relative to the midline 18. The first side 14 may extend away from the midline 18 to a first end 32 of the first plate 12, and the second side 16 may extend away from the midline 18 to a second end 34 of the first plate 12. Additionally, the first plate 12 may define a left border 15 and a right border 17 (from the top view perspective depicted with reference to FIGS. 3 and 4).

The first plate 12 may include various features suitable to secure the runner base 50 to the fielder base 70. As mentioned above, the first plate 12 may include the anchor aperture 20 defined on the first side 14, which may be configured to receive the ground anchor 72 of the fielder base 70. In some embodiments, the first plate 12 further includes a first one or more connection apertures 24 defined on the second side 16. As discussed in greater detail below, the first one or more connection apertures 24 may facilitate securing the first plate 12 to the runner base 50. For example, and as depicted with additional reference to FIG. 17, the first one or more connection apertures 24 may be shaped to receive a first one or more fastening elements 58, which may be configured to mechanically engage the runner base 50, such that the first plate 12 is secured to the runner base 50.

In some embodiments, the first one or more connection apertures 24 are arranged in a square pattern. For example, the first one or more connection apertures 24 may be arranged in a square fashion about a square perimeter defined by the second side 16. For instance, the midline 18, the second end 34, the portion of the left border 15 on the second side 16, and the portion of the right border 17 on the second side 16, may define a square (or substantially square) region defining the second side 16. In this sense, the second side 16 may define four corners: a first corner 19 where the second end 34 meets the left border 15, a second corner 21 where the second end 34 meets the right border 17, a third corner 23 where the left border 15 meets the midline 18, and a fourth corner 25 where the right border 17 meets the midline 18.

In some embodiments, three such connection apertures 24 are defined on each side of the square formed by the perimeter of the second side 16. Thus, the first one or more connection apertures 24 may be a first plurality of connection apertures 24, which may include a first connection aperture 24*a*, a second connection aperture 24*b*, a third connection aperture 24*c*, a fourth connection aperture 24*d*, a fifth connection aperture 24*e*, a sixth connection aperture 24*f*, a seventh connection aperture 24*g*, an eighth connection aperture 24*h*, a ninth connection aperture 24*i*, a tenth connection aperture 24*j*, am eleventh connection aperture 24*k*, and a twelfth connection aperture 24*l*. Of course, the first plate 12 may include any number of such connection apertures 24 arranged in any suitable fashion to afford the advantages discussed herein. For instance, two such connection apertures 24 may be defined on each side of the square formed by the perimeter of the second side 16, one such connection aperture 24 may be defined on each such side, four such apertures 24 may be defined on each side, one or more such connection apertures 24 may be defined on one or more such sides, and so on. In other embodiments, the one or more connection apertures are arranged in a different fashion (e.g., circular, in a line, an inner square, etc.).

In some embodiments, and as shown in greater detail with reference to FIG. 5, the first plate 12 includes one or more teeth 22 (e.g., spikes, narrow posts, fingers, etc.) protruding from the bottom face 38 on the second side 16. In some embodiments, four such teeth 22 protrude from each of the first, second, third, and fourth corners 19, 21, 23, 25 defined by the square shape of the second side 16. Thus, the one or more teeth 22 may include a plurality of teeth 22, which may include a first tooth 22*a* (e.g., on the first corner 19), a second tooth 22*b* (e.g., on the second corner 21), a third tooth 22*c* (e.g., on the third corner 23), and a fourth tooth 22*d* (e.g., on the fourth corner 25). Of course, the first plate 12 may include any number of such teeth 22 arranged in any suitable fashion to afford the advantages discussed herein. For instance, the one or more teeth 22 may be positioned anywhere on the second side 16, a portion of the one or more teeth 22 depicted herein may be included on the second side 16, five or more teeth 22 may be included on the second side 16, and so on.

Figure 20:
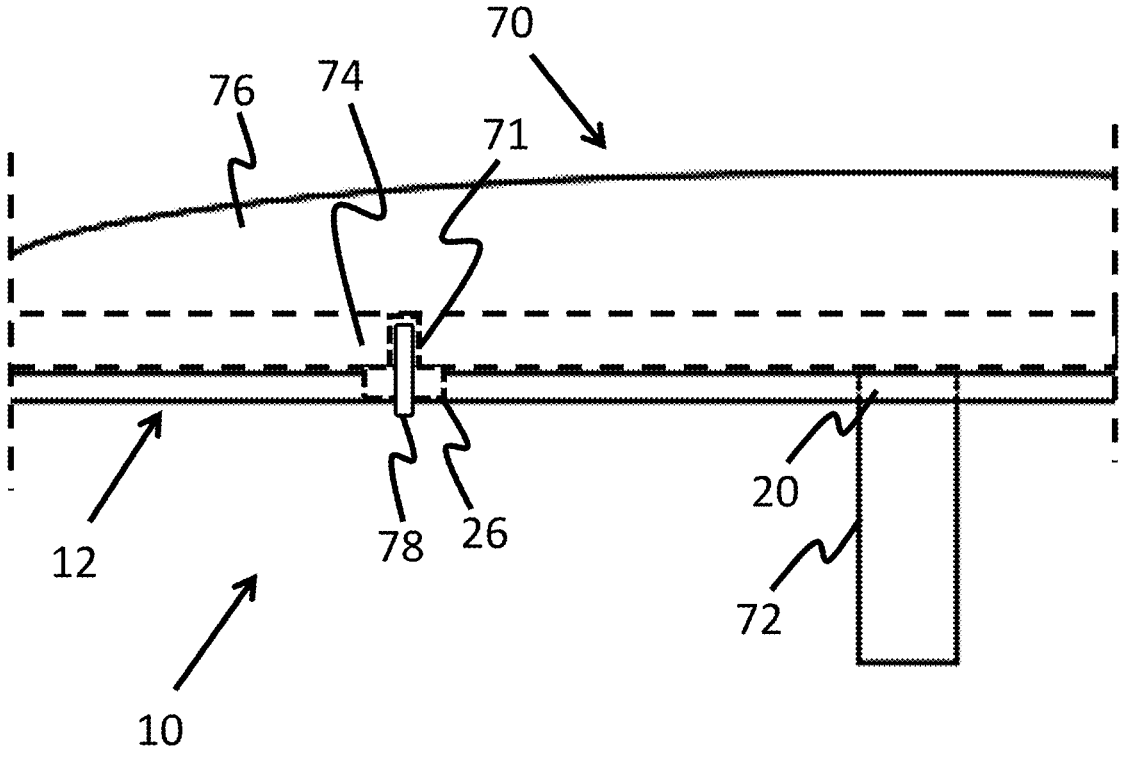
FIG. 20 is a detailed partial side view of the apparatus of FIG. 19, according to some embodiments of the present disclosure.

In some embodiments, the plate 12 includes a second one or more connection apertures 26 defined on the first side 14. As discussed in greater detail below, the second one or more connection apertures 26 may facilitate securing the first plate 12 to the fielder base 70. For example, and as depicted with additional reference to FIG. 20, the second one or more connection apertures 26 may be shaped to receive a second one or more fastening elements 78, which may be configured to mechanically engage the fielder base 70, such that the first plate 12 is secured to the fielder base 70. In some embodiments, the second one or more connection apertures 26 are shaped as slots. Advantageously, this may allow for leeway in the positions of the corresponding second one or more fastening elements 78 on the fielder base 70, such that the second one or more fastening elements 78 may be received in the second one or more connection apertures 26 when the ground anchor 72 of the fielder base 70 is received in the anchor aperture 20.

In some embodiments, the second one or more connection apertures 26 may be distributed laterally (e.g., in a line, parallel with the midline 18, etc.), and be longitudinally positioned in between the midline 18 and the first anchor aperture 20. In some embodiments, three such connection apertures 26 are defined on the first side 14. Thus, the second one or more connection apertures 26 may be a second plurality of connection apertures 26, which may include a first connection aperture 26*a*, a second connection aperture 26*b*, and a third connection aperture 26*c*. Of course, the first plate 12 may include any number of such connection apertures 26 arranged in any suitable fashion to afford the advantages discussed herein. For instance, the first plate 12 may include one connection aperture 26, two connection apertures 26, four connection apertures 26, and so on.

Referring particularly to FIG. 4, various exemplary dimensions of the first plate 12 are shown, according to some embodiments of the present disclosure. As discussed herein, such dimensions are approximate and exemplary in nature. It should be appreciated that the apparatus 10 may be provided in any number of dimensions suitable to provide the advantages discussed herein.

The plate 12 may have an overall longitudinal length (e.g., "height") H1, and a lateral length (e.g., "width") W1. Depending on the implementation, H1 may be 23.5" and W1 may be 16". The anchor aperture 20 may define a square (or substantially square) shape, and accordingly have a width W2 and a height H4. In some embodiments, the one or more teeth 22 (particularly when arranged on the corners of the second side 16) may be separated by a distance H2. Depending on the implementation, H2 may be 14.375". In some embodiments, the outermost connection apertures 22 on a side of the square formed by the second side 16 may be separated by a distance H3. Depending on the implementation, H2 may be 10.25". Accordingly, adjacent connection apertures 22 may be separated by a distance of 5.125". In some embodiments, the second one or more connection apertures 26 may have a length H4 (e.g., such that the second one or more connection apertures 26 are shaped as slots), and have rounded edges defining a diameter D1. Depending on the implementation, H4 may be 0.56" and D1 may be 0.1875". In some embodiments, the one or more teeth 22 may each have a diameter D2 and, as shown with additional reference to FIG. 5, a length H5. Depending on the implementation, D2 may be 0.377" and H5 may be 2".

As discussed in greater detail below with reference to FIG. 25, the first plate 12 may further include an additional anchor aperture 28 (such that the anchor aperture 20 may be considered a first anchor aperture 20, and the anchor aperture 28 may be considered a second anchor aperture 28). The second anchor aperture 28 may have similar or the same dimensions as the first anchor aperture 20, and be defined on the second side 16 of the first plate 12 (e.g., in a center of the second side 16). The longitudinal distance between the first and second anchor apertures 20, 28 may be defined by a distance H2. Depending on the implementation, H2 may be 15".

Figure 6:
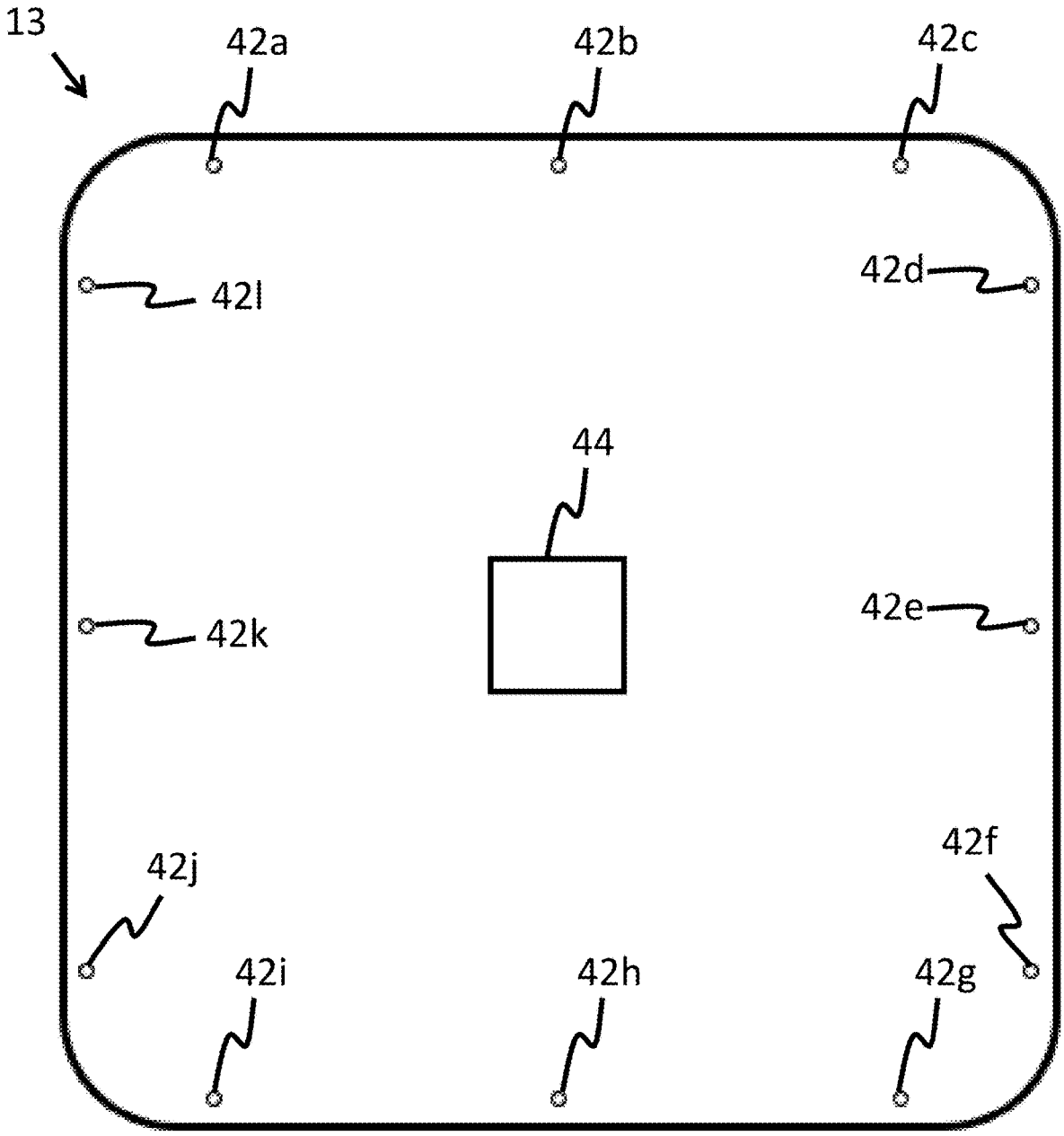
FIG. 6 is a top view of a second plate of the apparatus of FIG. 1, according to some embodiments of the present disclosure.
Figure 7:
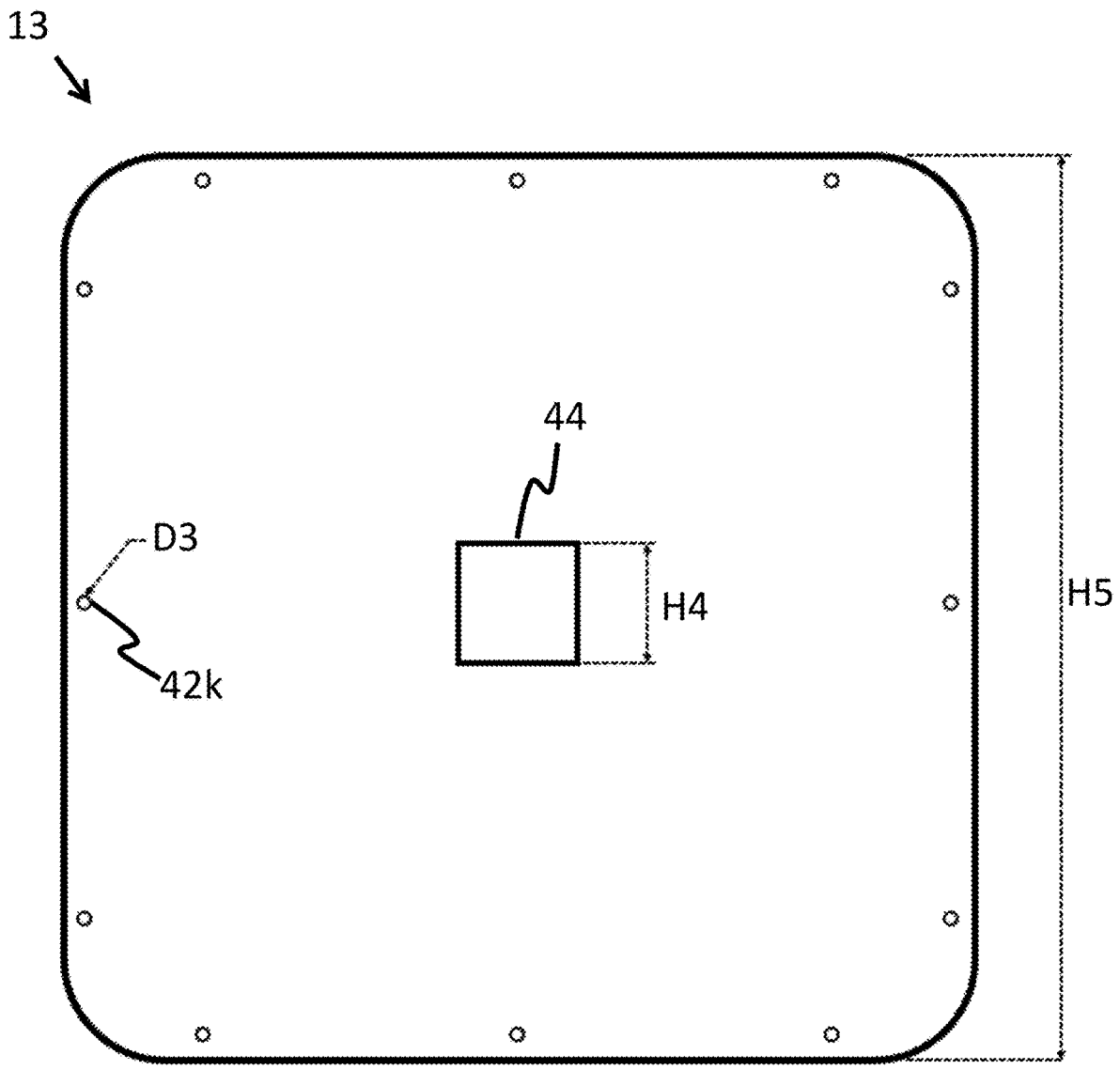
FIG. 7 top view of a second plate of the apparatus of FIG. 1, according to other embodiments of the present disclosure.

Referring now to FIGS. 6 and 7, the second plate 13 is shown in greater detail, according to some embodiments of the present disclosure. As shown, the second plate 13 may be a flat (or substantially flat) plate that defines a square (or substantially square, such as a square with rounded edges) shape. In some embodiments, the second plate 13 includes a third one or more connection apertures 42. As depicted with additional reference to FIGS. 1 and 2, when the second plate 13 is disposed above the first plate 12, each of the first one or more connection apertures 24 may correspond to (e.g, be aligned with) one of the third one or more connection apertures 42. As discussed in greater detail below, the second plate 13 including the third one or more connection apertures 42 may be disposed between the first plate 12 and the runner base 50, and facilitate bolstering the security and/or the position of the runner base 50 when the runner base 50 is secured to the first plate 12. For example, and as depicted with additional reference to FIG. 17, the third one or more connection apertures 42 (along with the first one or more connection apertures 24) may be shaped to receive the first one or more fastening elements 58.

As suggested above, the third one or more connection apertures 42 may be arranged in a square fashion about a square perimeter defined by the second plate 13. In some embodiments, three such connection apertures 42 are defined on each side of the square formed by the perimeter of the second plate 13. Thus, the third one or more connection apertures 42 may be a second plurality of connection apertures 42, which may include a first connection aperture 42*a*, a second connection aperture 42*b*, a third connection aperture 42*c*, a fourth connection aperture 42*d*, a fifth connection aperture 42*e*, a sixth connection aperture 42*f*, a seventh connection aperture 42*g*, an eighth connection aperture 42*h*, a ninth connection aperture 42*i*, a tenth connection aperture 42*j*, am eleventh connection aperture 42*k*, and a twelfth connection aperture 42*l*. Of course, the second plate 13 may include any number of such connection apertures 42 arranged in any suitable fashion to afford the advantages discussed herein. For instance, two such connection apertures 42 may be defined on each side of the square formed by the perimeter of the second plate 13, one such connection aperture 42 may be defined on each such side, four such apertures 42 may be defined on each side, one or more such connection apertures 42 may be defined on one or more such sides, and so on.

In some embodiments, the second plate 13 defines a square shape, and thus a length of each side may be defined by a height H5. Depending on the implementation, H1 may be 11.875". As discussed in greater detail below with reference to FIG. 25, the second plate 13 may further include an anchor aperture 44, which may have the same or similar dimensions as the anchor aperture 20 of the first plate 12, or the anchor aperture 28 of the first plate 12. Accordingly, the anchor aperture 44 may have a height and width of H4.

Figure 8:
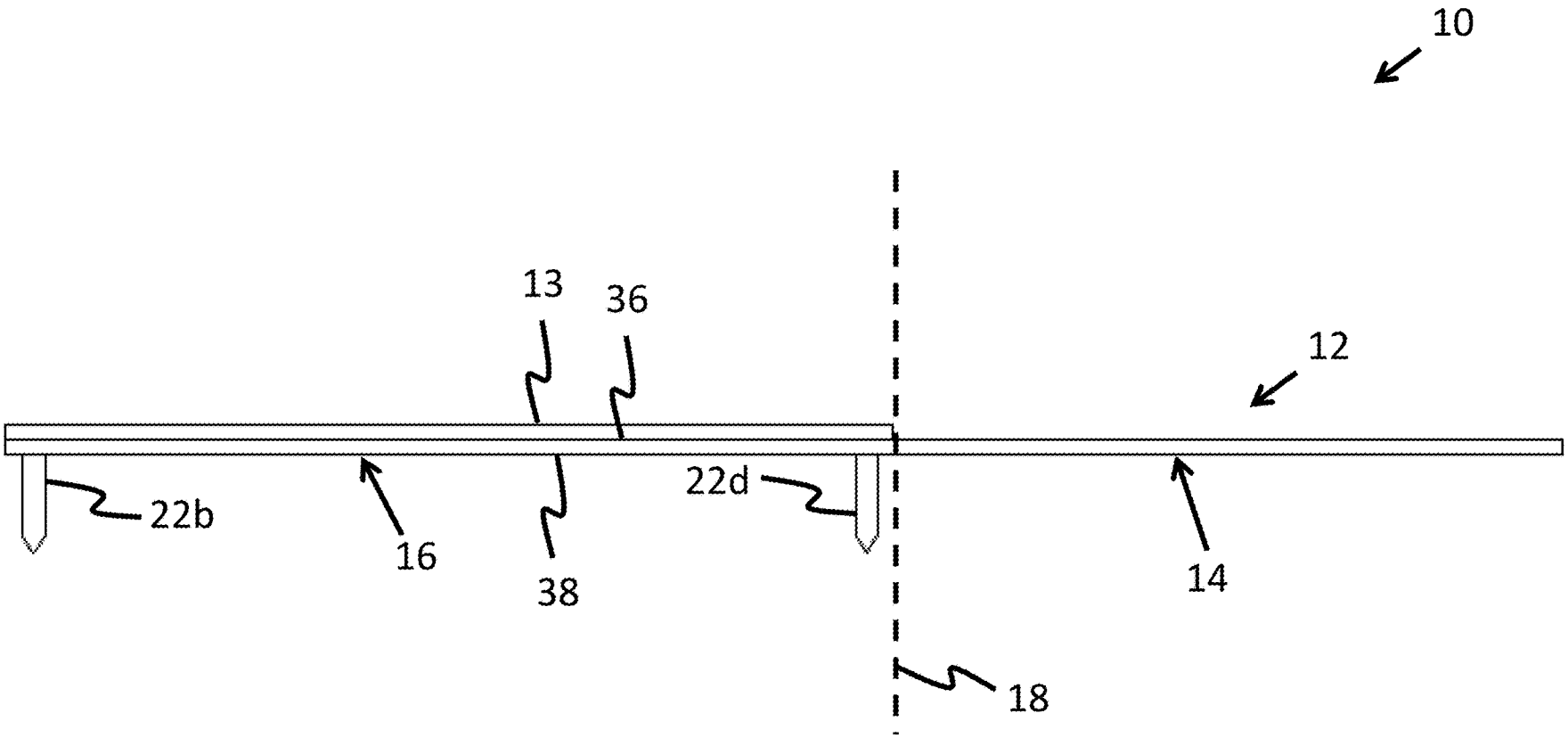
FIG. 8 is a side view of the apparatus of FIG. 1, according to some embodiments of the present disclosure.

Referring now to FIG. 8, a side view of the apparatus 10 is shown, according to some embodiments of the present disclosure. As mentioned above, the second plate 13 may be disposed above the first plate 12. As shown with additional reference to FIG. 1, the second plate 13 may be disposed above the first plate 12 over the second side 16 of the first plate 12 (e.g., such that the first one or more connection apertures 24 are aligned with the third one or more connection apertures 42). As discussed in greater detail below, the second plate 13 may be secured to (or secured relative to) the first plate 12 and the runner base 50. For example, when the second plate 13 is disposed above the first plate 12, the first one or more connection apertures 24 of the first plate 12 may be aligned with the third one or more connection apertures 42 of the second plate 13. Thus, the first and third one or more connection apertures 24, 42, correspondingly aligned as mentioned above, may receive the corresponding first one or more fastening elements 58 vertically extending therethrough.

Figure 9:
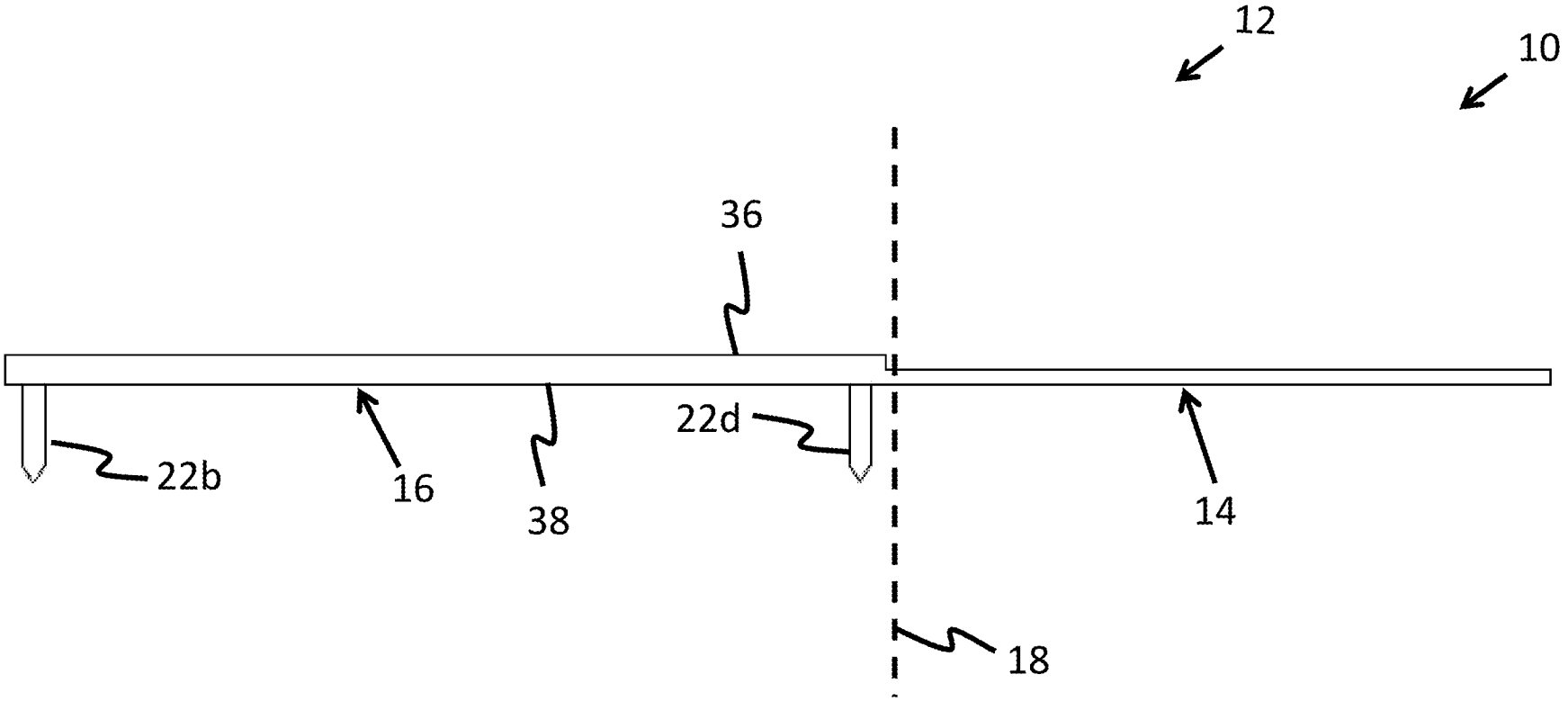
FIG. 9 is a side view of the apparatus of FIG. 1, according to other embodiments of the present disclosure.

Referring now to FIG. 9, a side view of the apparatus 10 is shown, according to other embodiments of the present disclosure. In some embodiments, the apparatus 10 does not include the second plate 13. As a first example, and as shown, in some cases the first plate 12 includes a thickened region on the second side 16. As a second example, the apparatus 10 simply includes the first plate 12 (e.g., without the second plate 13 or the aforementioned thickened region, as shown with reference to FIGS. 3-5).

Figure 10:
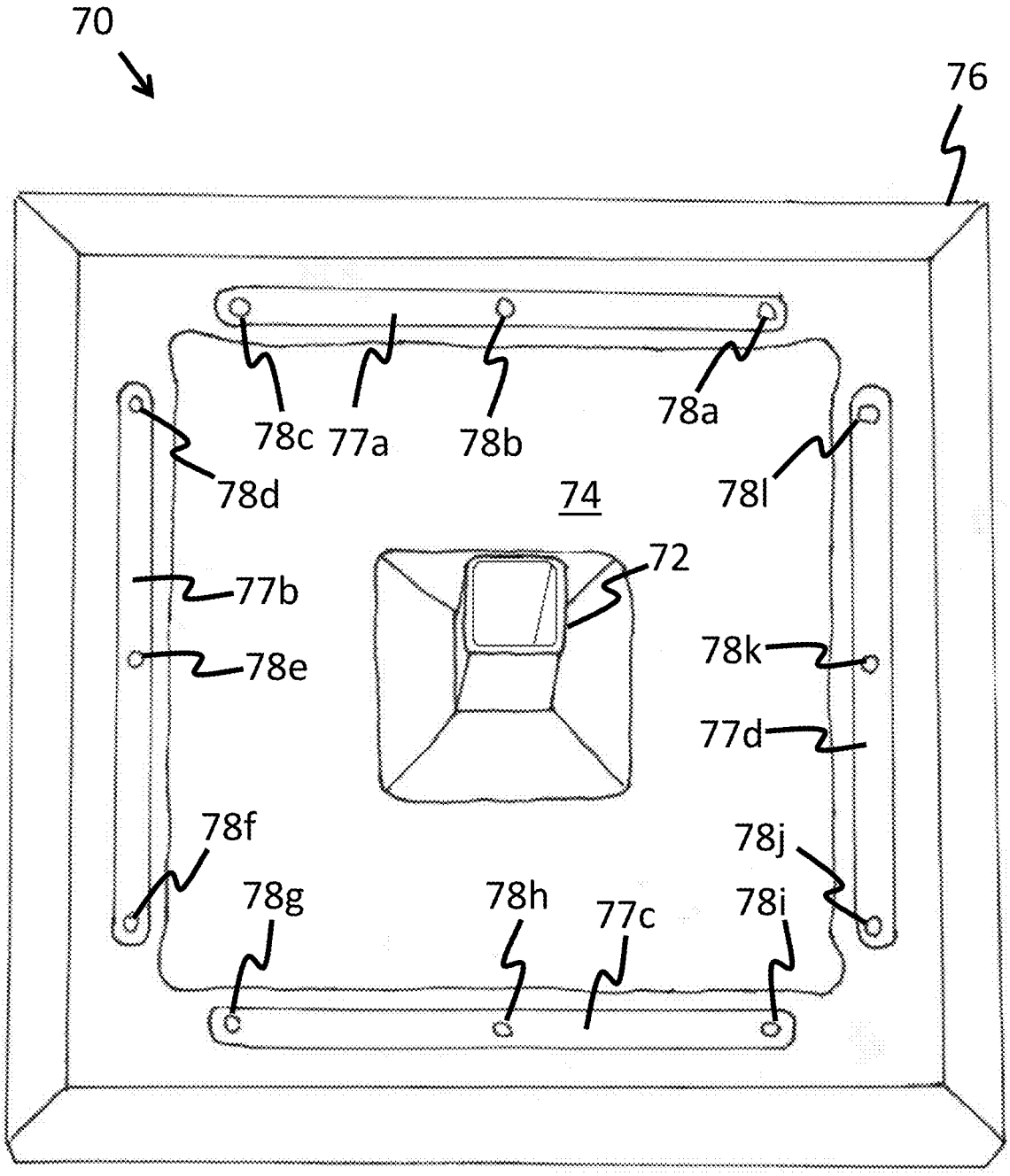
FIG. 10 is a bottom view of a fielder base, according to some embodiments of the present disclosure.

Referring now to FIG. 10, a bottom side of the fielder base 70 is shown, according to some embodiments of the present disclosure. Depending on the implementation, the fielder base 70 may be a conventional first base (e.g., manufactured by Schutt). The fielder base 70 may include a top pad 76 disposed on a rigid core 74. The fielder base 70 may further include an ground anchor 72 extending downward from the rigid core 74. In some embodiments, the fielder base 70 includes one or more fastening members 77 configured to secure the top pad 76 to the rigid core 74. The one or more fastening members 77 may be secured to the rigid core 74 by the second one or more fastening elements 78, such that an inner region of the top pad 76 is pinned between the one or more fastening members 77 and the rigid core 74. As mentioned above, the second one or more connection apertures 26 of the first plate 12 may be shaped to receive the second one or more fastening elements 78, which may be configured to mechanically engage the fielder base 70, such that the first plate 12 is secured to the fielder base 70. In this sense, a number fastening elements 78 may be removed, one of the one or more fastening members 77 may be removed, and such fastening elements 78 may be advanced through the second one or more connection apertures 26 of the first plate 12 prior to being re-engaged with the rigid core 74 of the fielder base 70.

Figure 11:
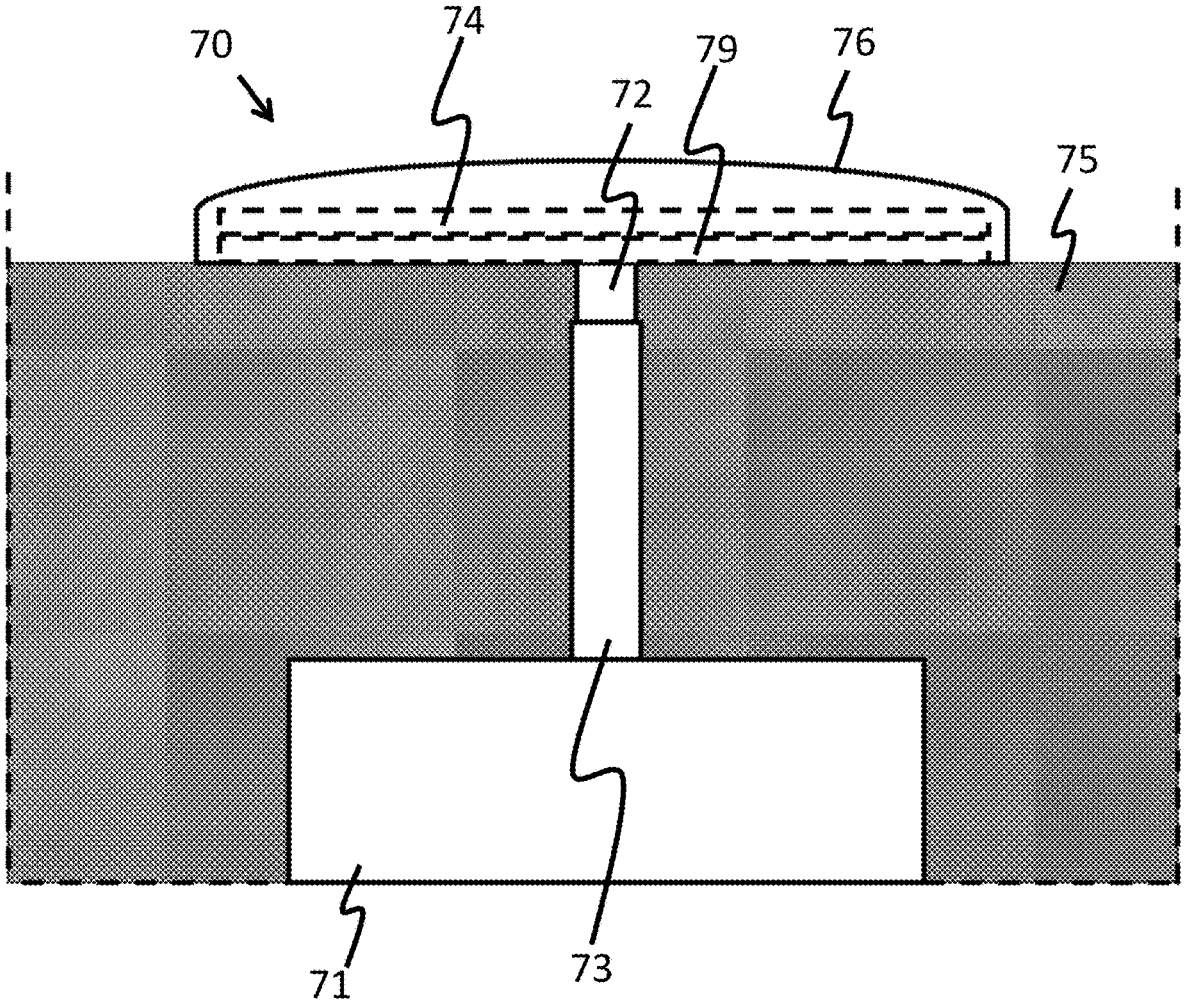
FIG. 11 is a side view of a fielder base, according to some embodiments of the present disclosure.

Referring now to FIG. 11, a side view of the fielder base 70 implemented on a ground surface 75 (e.g., a baseball field) is shown, according to some embodiments of the present disclosure. For instance, FIG. 11 may depict the first base as conventionally implemented in the prior art. In some embodiments, the ground anchor 72 (extending downwardly from the rigid core 74) is received by an anchor sleeve 73, which is fixed to a concrete base 71 situated within the ground surface 75.

Figure 12:
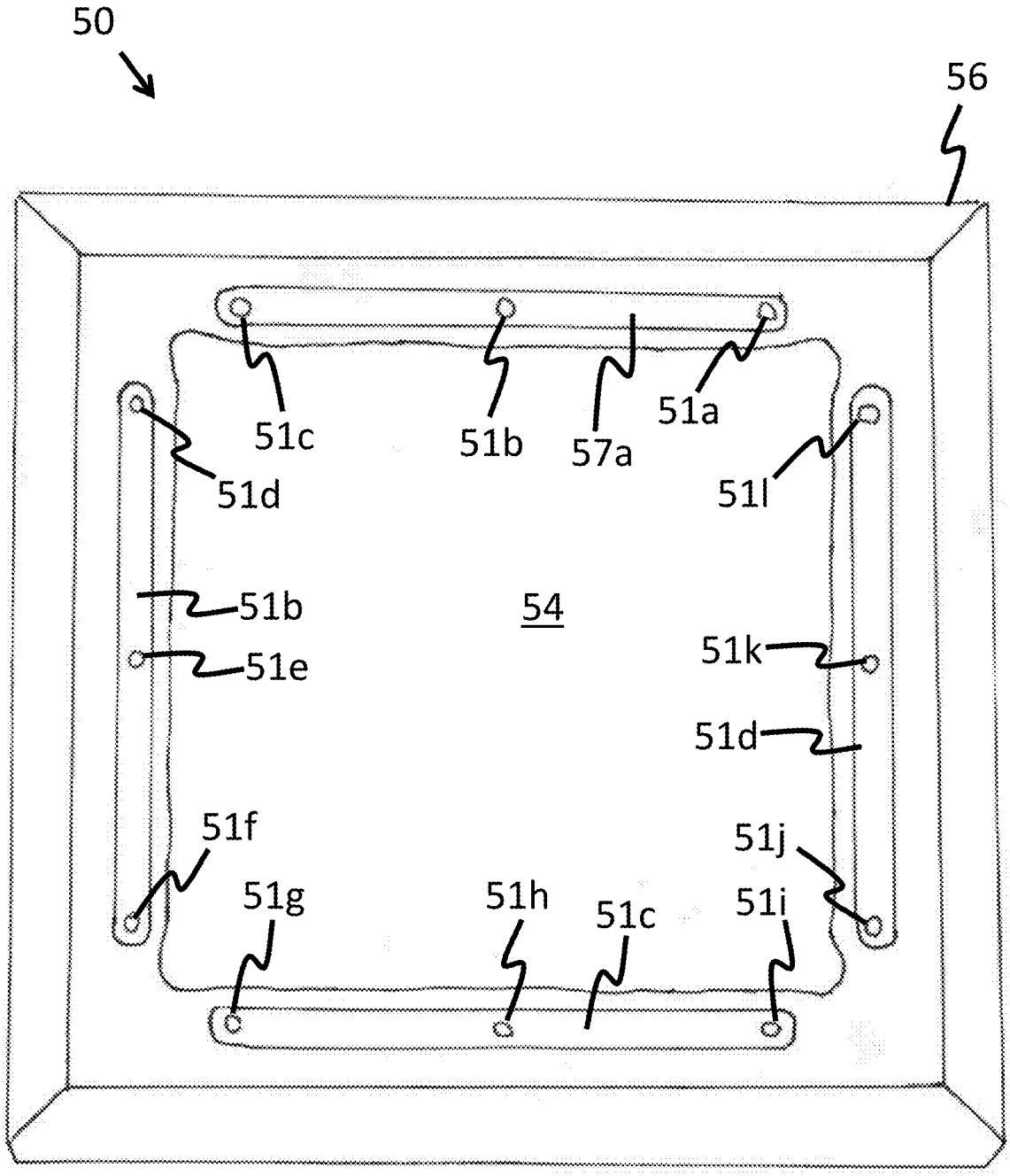
FIG. 12 a bottom view of a runner base, according to some embodiments of the present disclosure.
Figure 13:
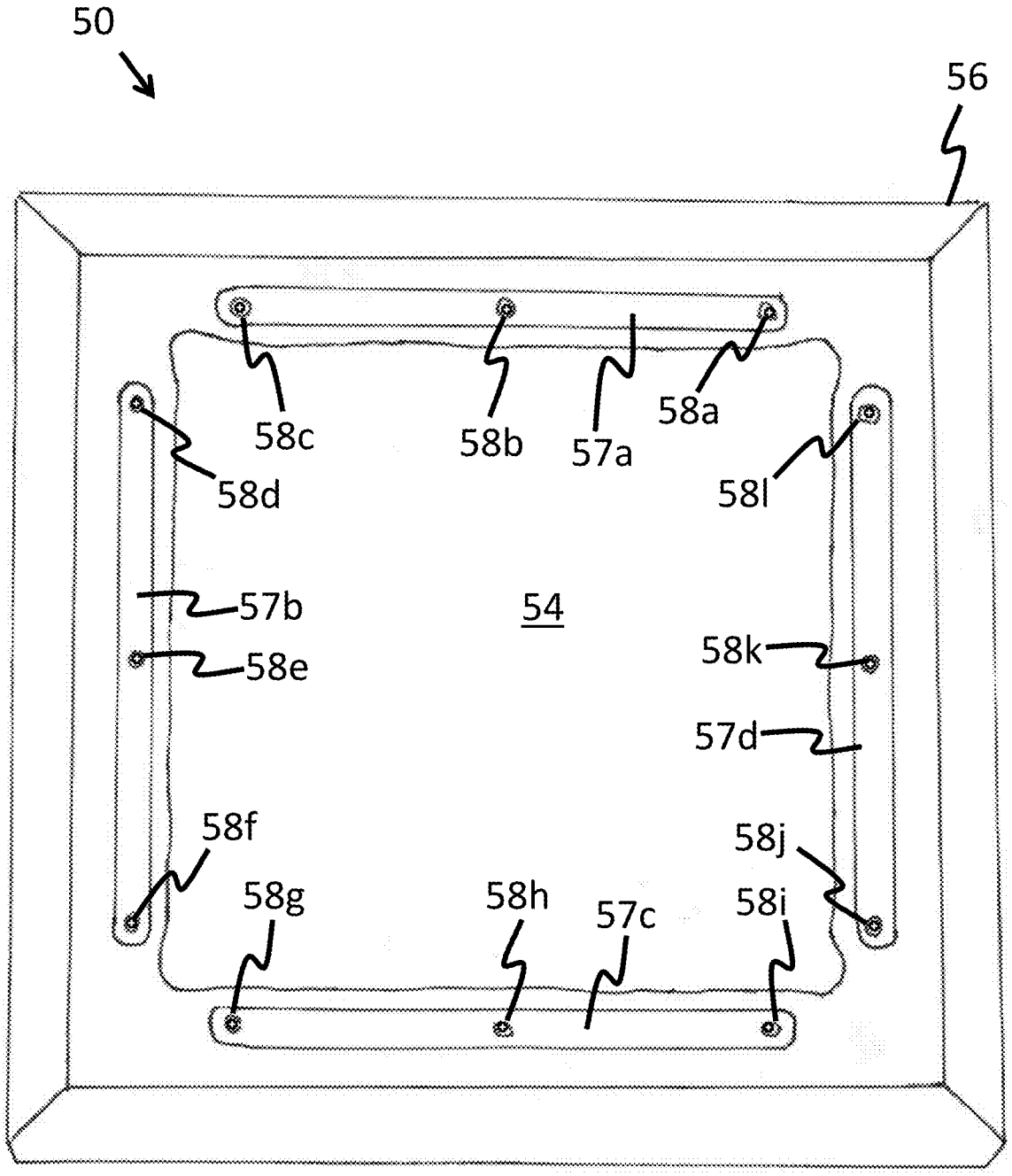
FIG. 13 is a side view of a runner base, according to some embodiments of the present disclosure.
Figure 14:
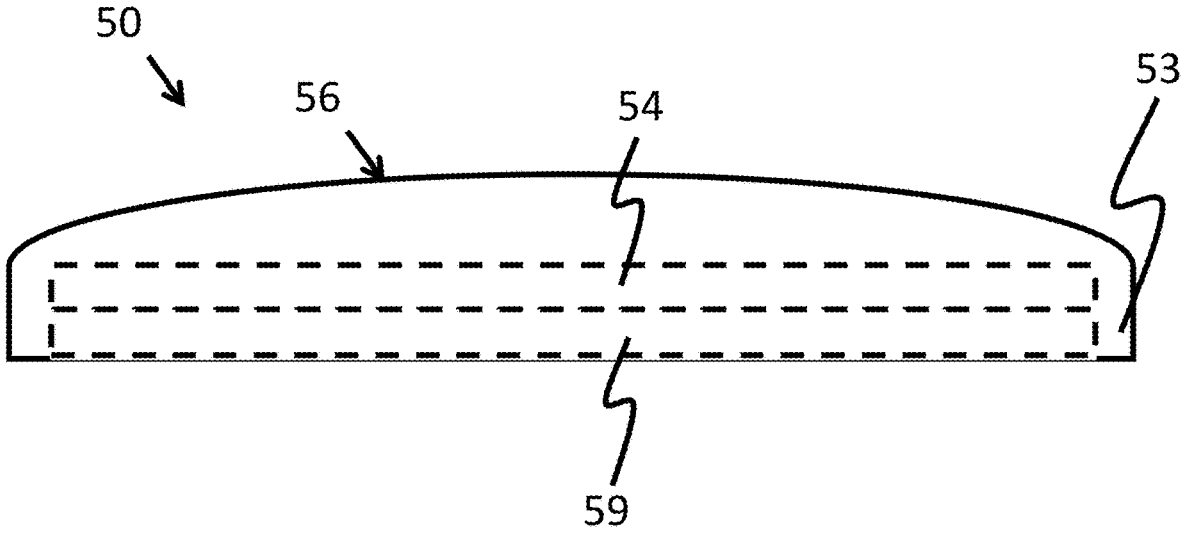
FIG. 14 is a bottom view of the second plate of the apparatus of FIG. 1 secured to a runner base, according to some embodiments of the present disclosure.

Referring now to FIGS. 12-14, the runner base 50 is shown, according to some embodiments of the present disclosure. Depending on the implementation, the runner base 50 may be a conventional base (e.g., manufactured by Schutt). Similar to the fielder base 70, in some embodiments, the runner base 50 includes a first one or more fastening members 57 configured to secure a top pad 56 to a rigid core 54. The one or more fastening members 57 may be secured to the rigid core 54 by the first one or more fastening elements 58. For example, the first one or more fastening elements 58 may be received by corresponding holes on the one or more fastening members 57 and one or more corresponding fastening holes 51 defined on the rigid core 54. Accordingly, when the first one or more fastening elements 58 are inserted through the corresponding holes on the one or more fastening members 57 and secured within the one or more fastening holes 51, an inner region of the top pad 56 may be pinned between the one or more fastening members 57 and the rigid core 54. As mentioned above, the first and third one or more connection apertures 24, 42 of the first and second plates 12, 13 may be shaped to receive the first one or more fastening elements 58, which may be configured to mechanically engage the rigid core 54 runner base 50, such that the first plate 12 is secured to the runner base 50. In this sense, the first one or more fastening elements 58 may be removed, the one of the one or more fastening members 57 may be removed, and the first one or more fastening elements 58 may be returned into the one or more fastening holes 51 after being advanced through the first one or more connection apertures 24 of the first plate 12, along with the third one or more connection apertures 42 of the second plate 13.

In some embodiments, and as shown with particular reference to FIG. 13, a lower rim 53 of the top pad 56 may extend below the rigid core 54, such that an inner cavity 59 below the rigid core 54 and within the bounds of the top pad 56 may be formed. In such cases where the apparatus 10 includes the second plate 13 and the runner base 50 is disposed atop the second plate 13, the second plate 13 may be disposed in the inner cavity 59. Generally, the runner base 50 may be configured the same or similar to the fielder base 70, and vice-versa. For instance, in some embodiments the runner base 50 does not include a ground anchor, such as the ground anchor 72 of the fielder base; however, in other embodiments, and as shown with reference to FIG. 25, the runner base 50 does include a ground anchor 52.

As suggested above, and as shown with particular reference to FIG. 13, the first one or more fastening elements 58 may be configured to mechanically engage (e.g., via threaded engagement, screw-in, etc.) the rigid core 54 via the one or more corresponding fastening holes 51 defined on a lower surface of the rigid core 54. In some embodiments, the one or more fastening holes 51 (and, thus, the first one or more fastening elements 58) may be arranged in a square fashion about the sides of the runner base 50 (e.g., corresponding to or otherwise aligned with the arrangement of the first and third one or more connection apertures 24, 42 of the first and second plates 12, 13).

In some embodiments, three such fastening holes 51 are defined on each side of the square formed by the runner base 50 and three such fastening elements 58 may be secured therein. Thus, the one or more fastening holes 51 may be a plurality of fastening holes 51, and the one or more fastening elements 58 may be a plurality of fastening elements 58, which may include a first fastening hole 51*a* and a corresponding first fastening element 58*a*, a second fastening hole 51*b* and a corresponding second fastening element 58*b*, a third fastening hole 51*c* and a corresponding third fastening element 58*c*, a fourth fastening hole 51*d* and a corresponding fourth fastening element 58*d*, a fifth fastening hole 51*e* and a corresponding fifth fastening element 58*e*, a sixth fastening hole 51*f* and a corresponding sixth fastening element 58*f*, a seventh fastening hole 51*g* and a corresponding seventh fastening element 58*f*, an eighth fastening hole 51*h* and a corresponding eighth fastening element 58*h*, a ninth fastening hole 51*i* and a corresponding ninth fastening element 58*i*, a tenth fastening hole 51*j* and a corresponding tenth fastening element 58*j*, an eleventh fastening hole 51*k* and a corresponding eleventh fastening element 58*k*, and a twelfth fastening hole 51*l* and a corresponding twelfth fastening element 58*l*.

Figure 15:
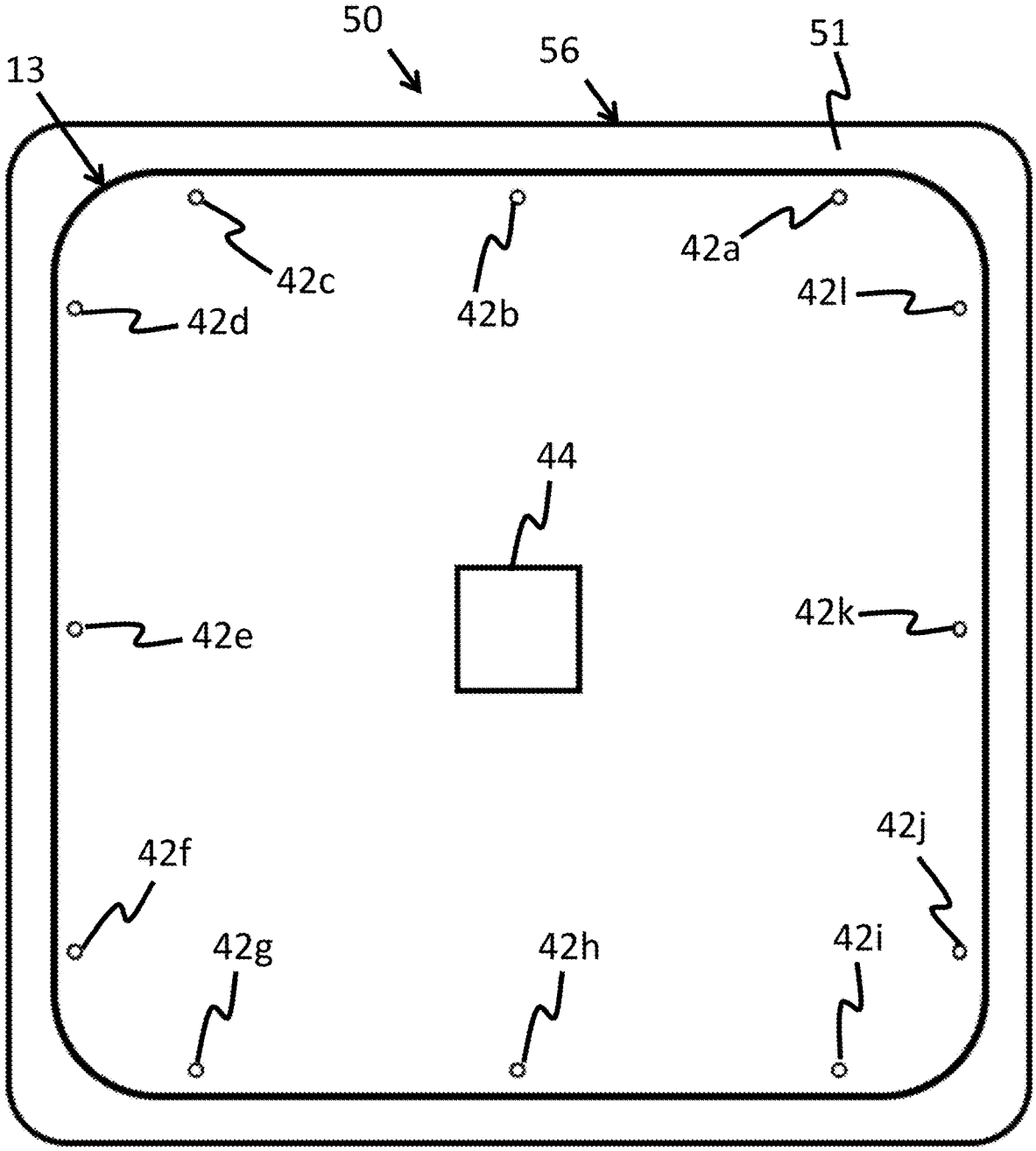

Referring now to FIG. 15, a lower view of the second plate 13 secured to the runner base 50 is shown, according to some embodiments of the present disclosure. As shown, the second plate 13 may be disposed below the runner base 50 (or, more particularly, below the rigid core 56 of the runner base 50). In some embodiments, the second plate 13 is disposed in the inner cavity 59 and/or within the lower rim 53 of the top pad 56. When the second plate 13 is secured to the runner base 50, the third one or more connection apertures 42 may be correspondingly aligned with the one or more fastening holes 51 on the rigid core 56 of the runner base 50.

Figure 16:
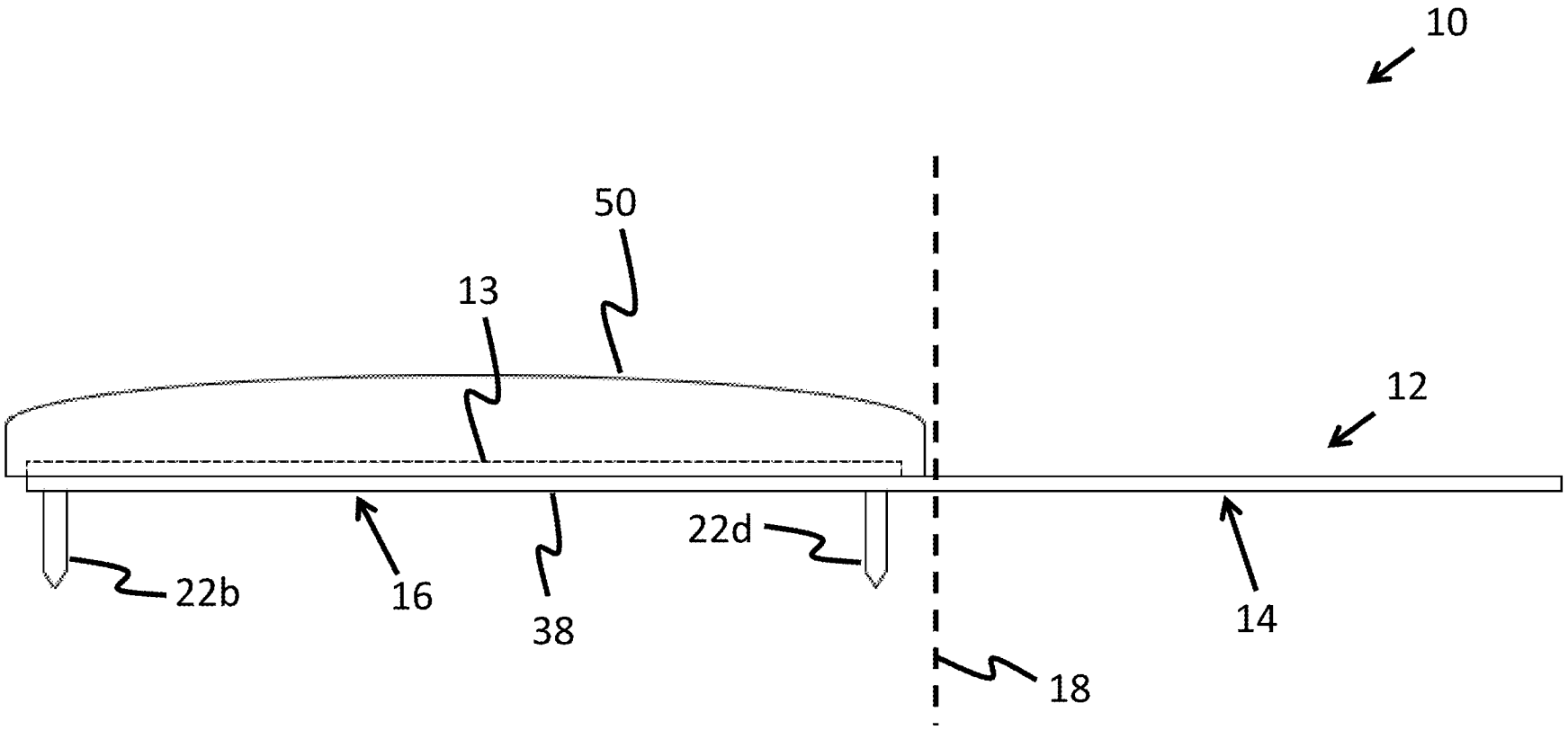
FIG. 16 is a side view of an apparatus for adapting a first base to a double first base having a fielder base and a runner base, according to further embodiments of the present disclosure.
Figure 17:
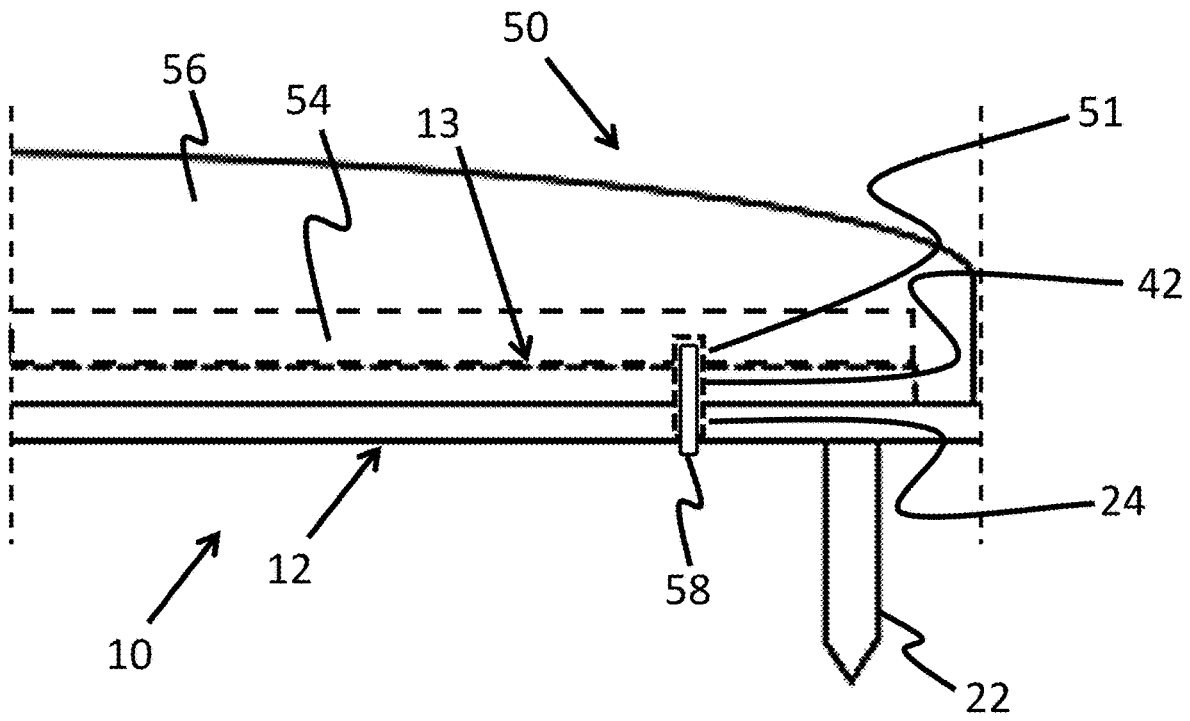
FIG. 17 is a detailed partial side view of the apparatus of FIG. 16, according to some embodiments of the present disclosure.
Figure 18:
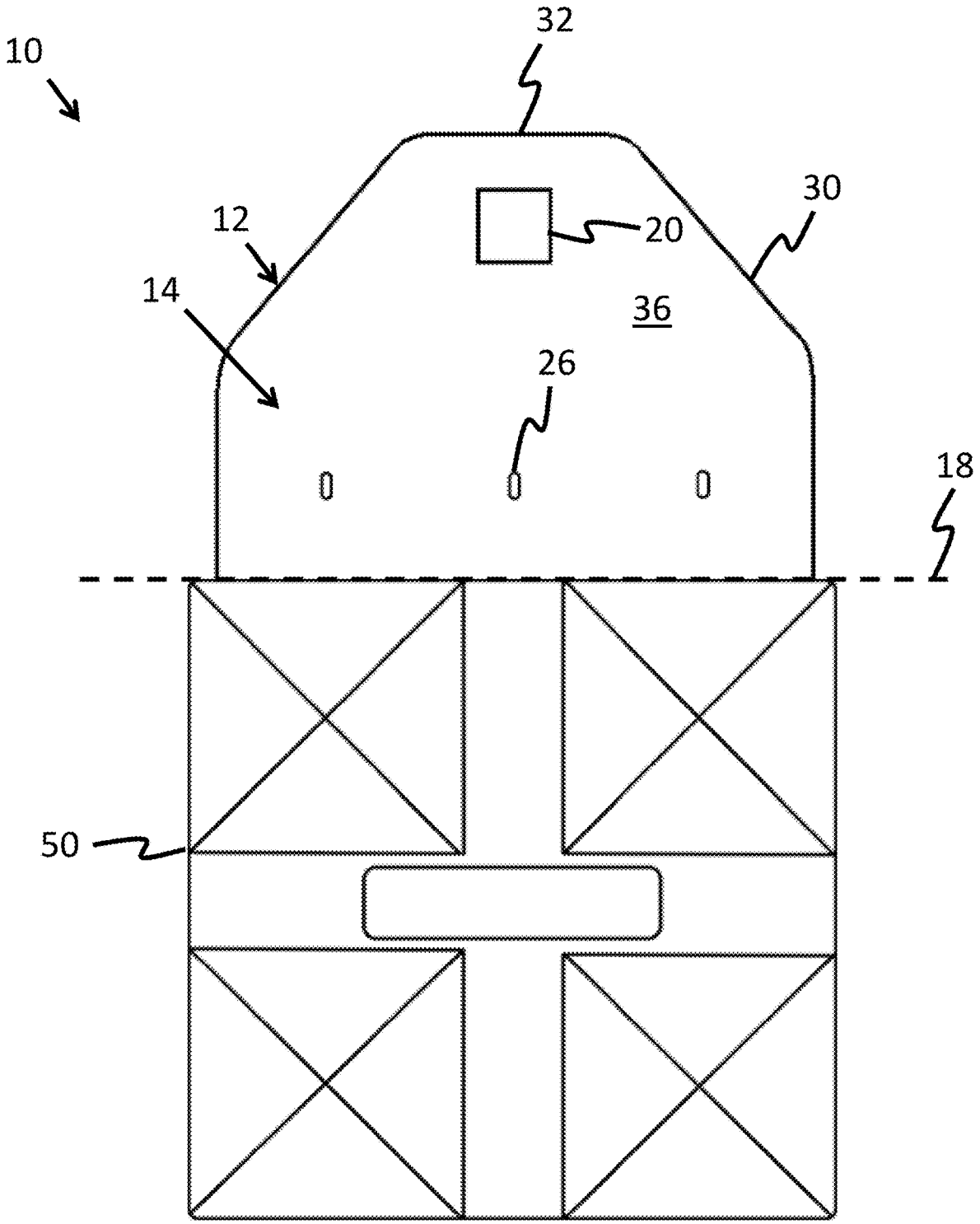
FIG. 18 is a top view of the apparatus of FIG. 16, according to some embodiments of the present disclosure.
Figure 19:
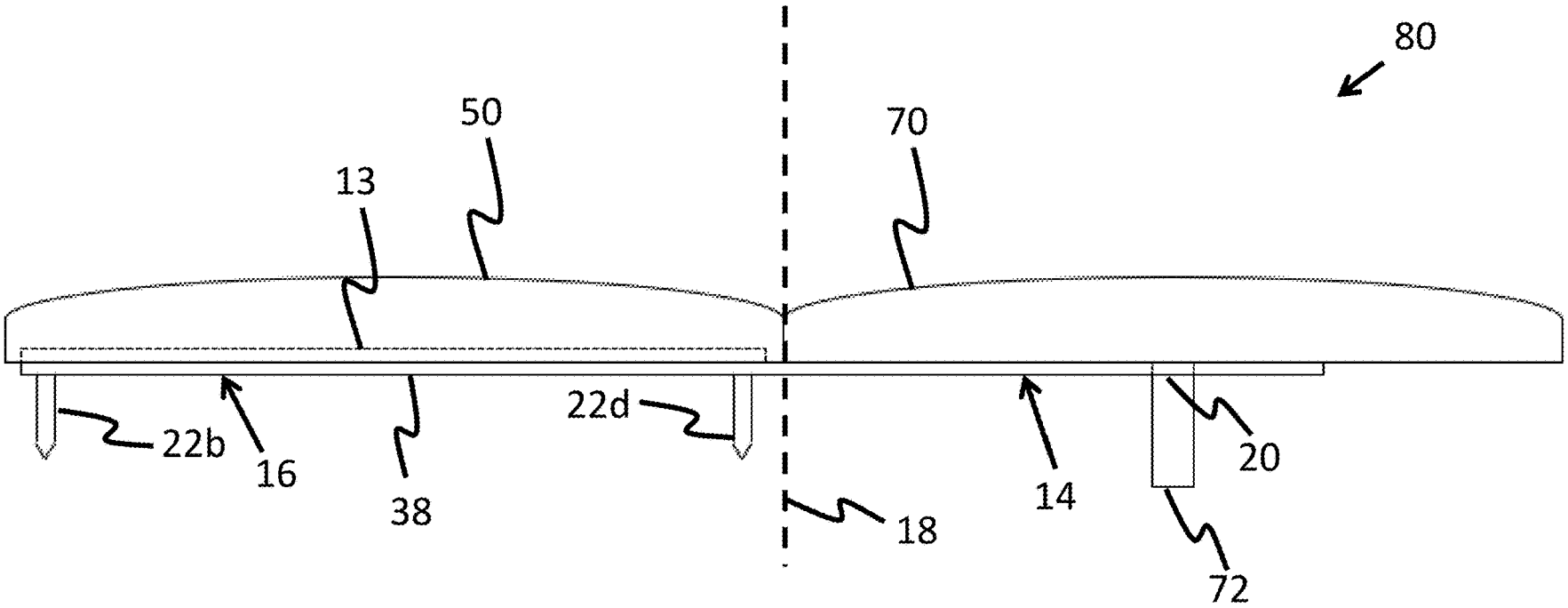
FIG. 19 is a side view of the apparatus of FIG. 16 assembled to the fielder base, according to some embodiments of the present disclosure.

Referring now to FIGS. 16-18, the apparatus 10 is shown, according to further embodiments of the present disclosure. For instance, as suggested above, the apparatus 10 may be provided to include the runner base 50. As discussed in greater detail below, the apparatus 10 may be secured to the fielder base 70 in order to provide a double first base. As shown, the runner base 50 may be disposed above the apparatus 10. In some embodiments, the runner base 50 is disposed above the apparatus 10 over the second side 16 of the first plate 12. Accordingly, the runner base 50 may be secured to the apparatus 10 by inserting each of the first one or more fastening elements 58 through the corresponding first one or more connection apertures 24 of the first plate 12, through the corresponding third one or more connection apertures 42 of the second plate 13, into the corresponding first one or more fastener holes 51 of the runner base 50, and securing the first one or more fastening elements 58 therein (e.g., mechanically engaging the runner base 50 with the first one or more fastening elements 58). As shown with particular reference to FIG. 18, when the runner base 50 is secured to the apparatus 10 as discussed above, the first side 14 of the first plate 12 may extend free of the runner base 50, which that the fielder base 70 may be secured thereon. In this sense, the midline 18 may generally be considered an upper border of the runner base 50 when the apparatus 10 is assembled as such.

Referring now to FIGS. 19-25, the apparatus 10 is shown assembled with the fielder base 70 to provide the double first base is shown, according to various embodiments of the present disclosure. The fielder base 70 may be disposed above the apparatus 10 over the first side 14 of the first plate 12, and therefore adjacent to (or substantially adjacent to, such that a small gap exists between) the runner base 50 disposed above the apparatus 10 (over the second side 16 of the first plate 12).

Figure 21:
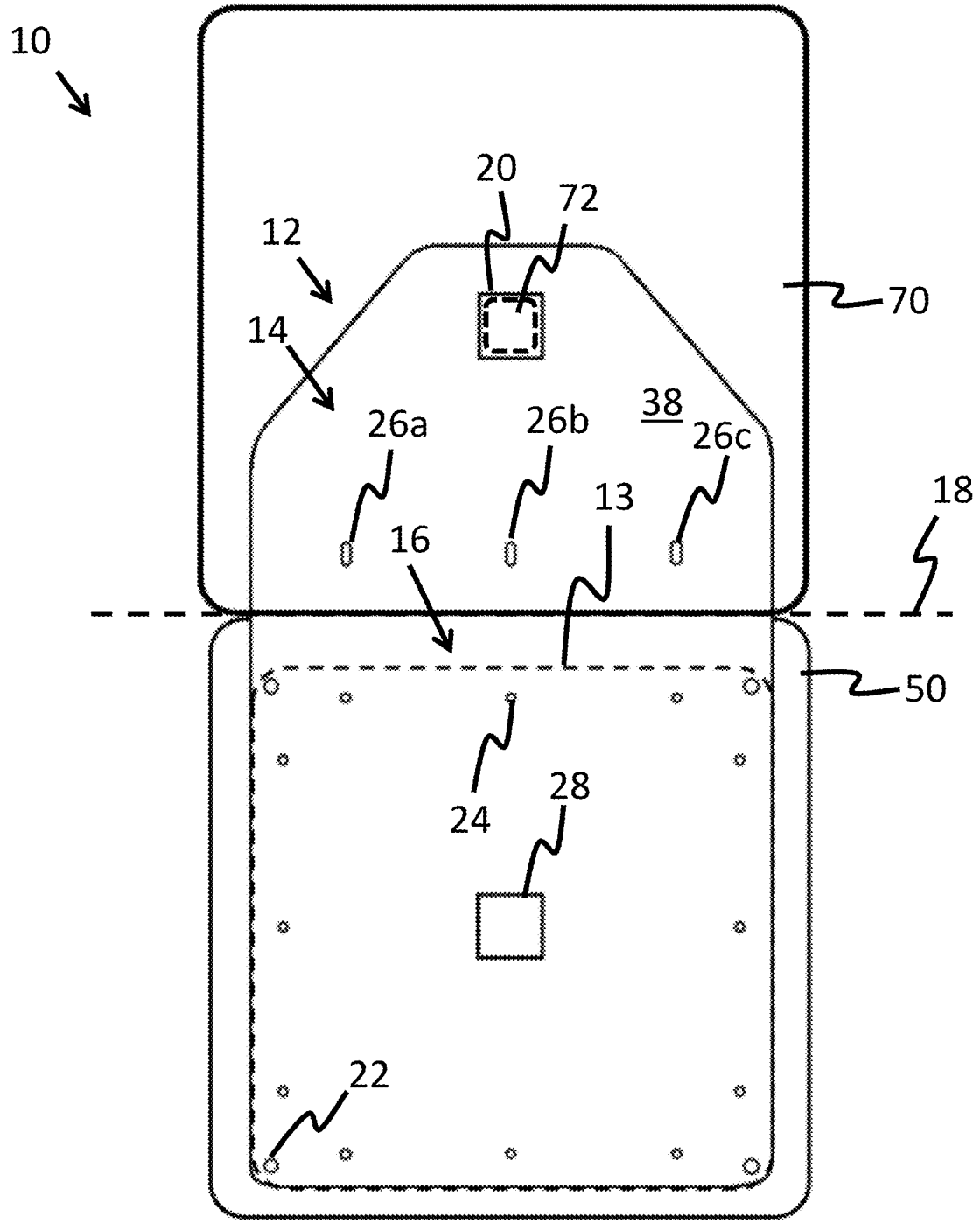
FIG. 21 is a bottom view is of the apparatus of FIG. 19, according to some embodiments of the present disclosure.
Figure 22:
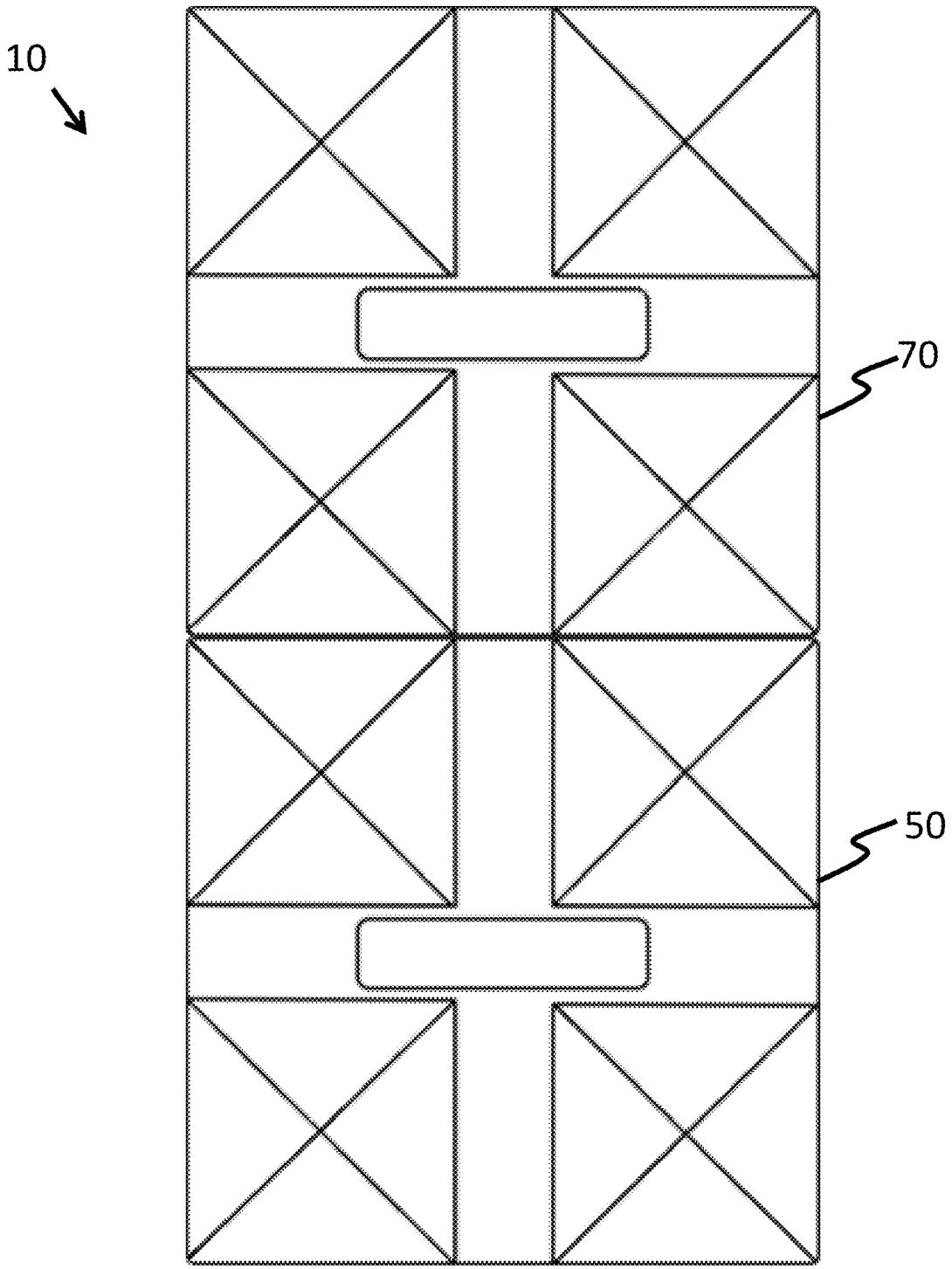
FIG. 22 is a top view is of the apparatus of FIG. 19, according to some embodiments of the present disclosure.
Figure 23:
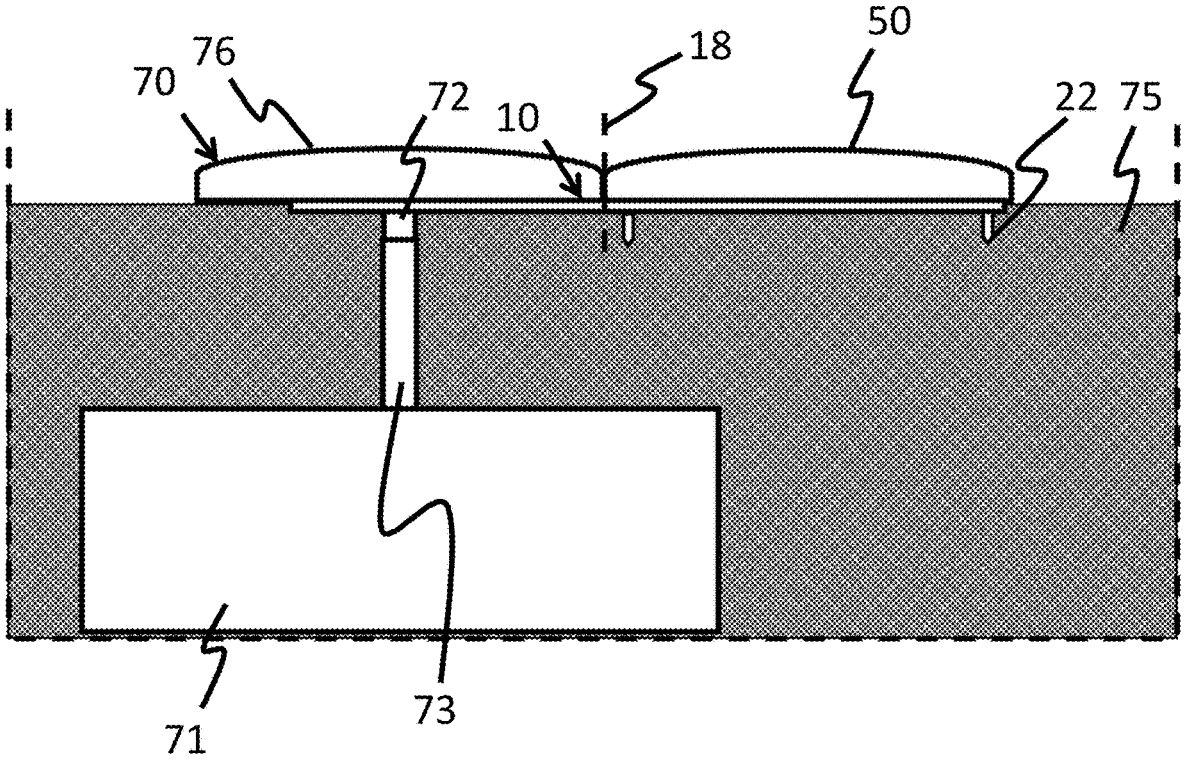
FIG. 23 is a side view is of the apparatus of FIG. 19, according to some embodiments of the present disclosure.

As shown with particular reference to FIG. 21, the anchor aperture 20 of the first plate 20 may substantially match the profile of the ground anchor 72 of the fielder base 70 in order to provide a close fit, sliding engagement between the inner surface of the anchor aperture 20 and the ground anchor 72 (e.g., the same or a similar shape, a slightly larger perimeter). Accordingly, the anchor aperture 20 may be shaped such that the first plate 12 mechanically engages and resists angular movement of the ground anchor 72 relative to the first plate 12. Advantageously, when a batter runs to the runner base 50 and strikes the runner base 50 with their foot, such impact would typically provide a twisting force on the connection between the anchor aperture 20 and the ground anchor 72, thus causing the entire assembly to pivot. By providing the anchor aperture 20 in a close-fit, sliding engagement with the ground anchor 72, such force is distributed to the first plate 12 rather than resulting in a pivoting of the double first base. Thus, more generally, the anchor aperture 20 may be shaped to prevent pivoting of the apparatus 10 itself when the batter strikes the runner base 50.

While the anchor aperture 20 and the ground anchor 72 are generally depicted herein as having a square shape (or generally square shape, such as a square shape with rounded edges), it should be appreciated that the anchor aperture 20 may be provided in any number of shapes suitable to resist angular movement of the ground anchor 72 relative to the first plate 12 (e.g., triangular, rectangular, an ellipse, etc.). In some embodiments, and as shown with additional reference to FIG. 1, the first plate 12 defines a tapered end 30 on the first side 14. Accordingly, the first side 14 (or a portion thereof) may narrow as the first side 14 extends towards the first end 32. Advantageously, such tapering may reduce an amount of material required to provide the apparatus 10, by removing surplus material not necessary to prevent the angular movement of the ground anchor 72 as discussed above.

As mentioned above, and as depicted with particular reference to FIG. 21, the second plate 13 may facilitate bolstering the security and/or position of the runner base 50 when the runner base 50 is secured to the first plate 12. For example, the second plate 13 may be disposed between the runner base 50 and the first plate 12, thus ensuring that a vertical position of the runner base 50 matches the fielder base 70, preventing the runner base 50 from deforming or twisting when a batter runs to and strikes the runner base 50, preventing the apparatus 10 itself from pivoting when the batter runs to and strikes the runner base 50, and so on.

Figure 24:
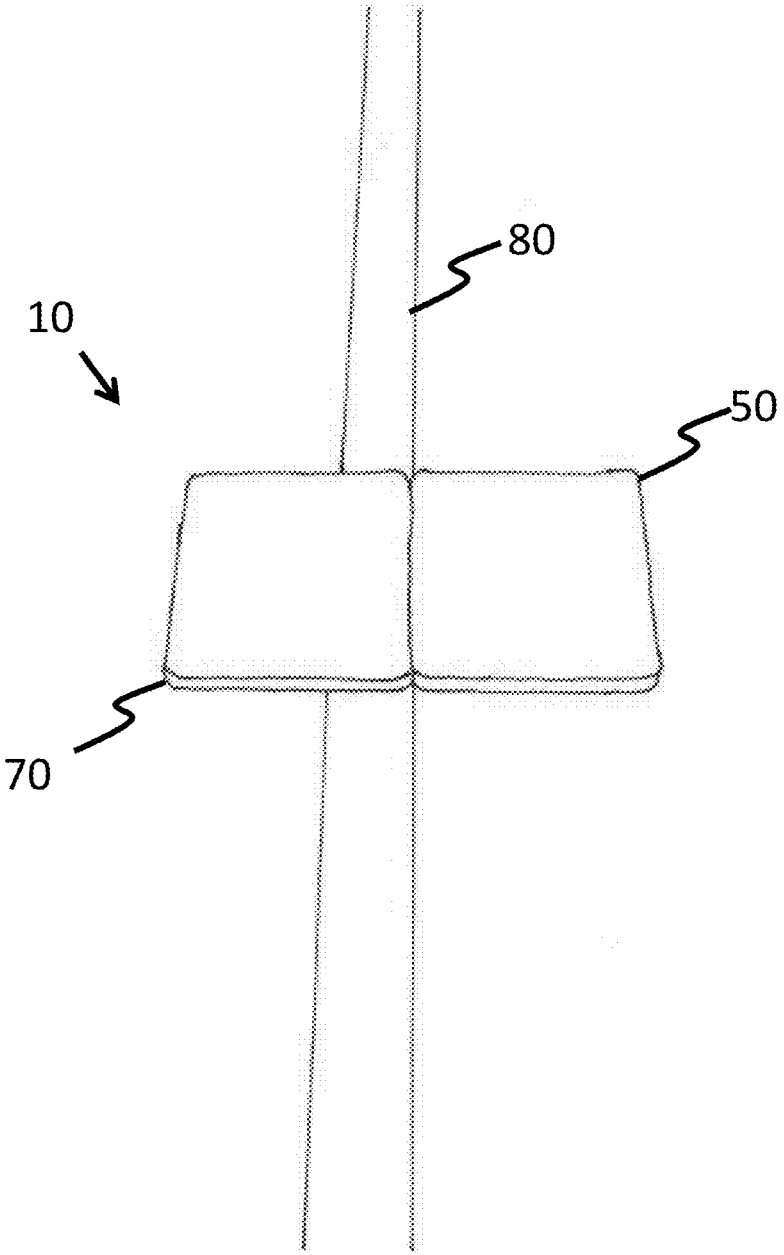
FIG. 24 is a upper perspective view of the apparatus of FIG. 19, according to some embodiments of the present disclosure.

As depicted with particular reference to FIG. 24, the apparatus 10 may be dimensioned such that when the fielder base 70 and the runner base 50 are secured to the first plate 12 (and, in some cases, the second plate 13), and the anchor post 72 of the fielder base 70 is disposed in the anchor sleeve 73, the right side of the fielder base 70 is aligned in suitable fashion with a baseline 80, and the left side of the runner base 50 is suitably aligned with the baseline 80.

Figure 25:
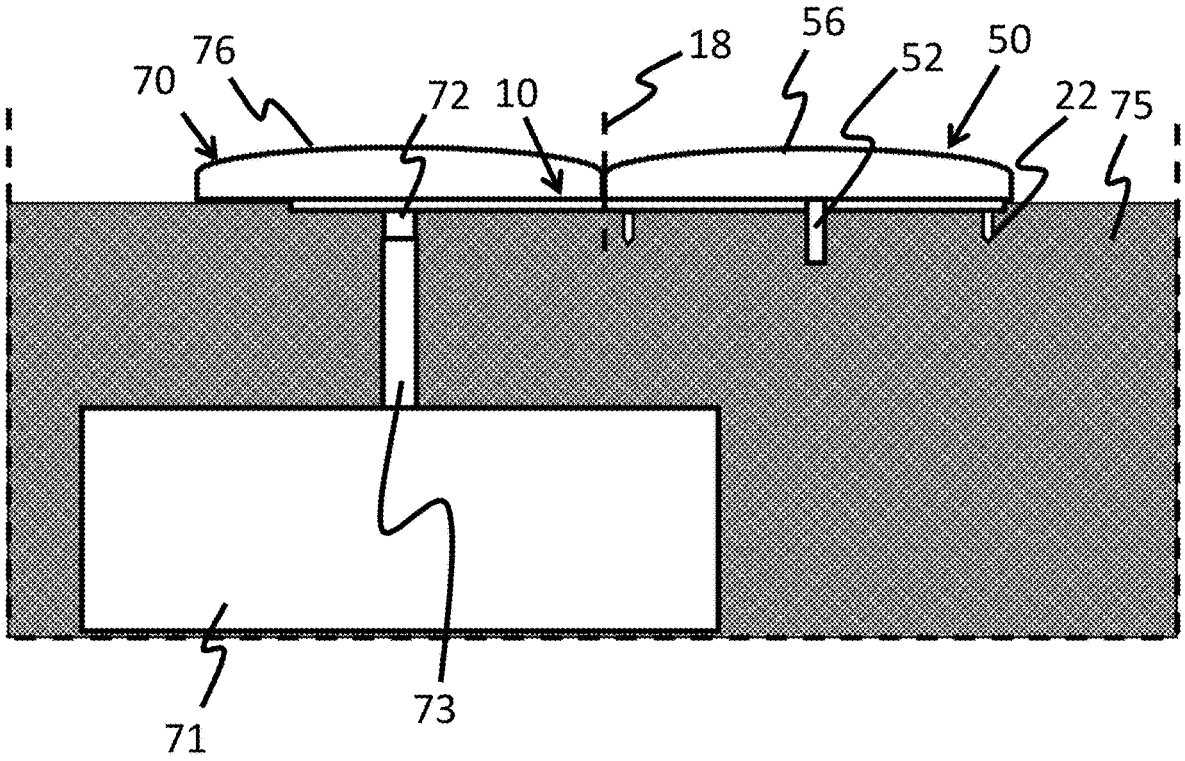
FIG. 25 is a side view of the apparatus of FIG. 19, according to further embodiments of the present disclosure.

As mentioned above, and as shown with particular reference to FIG. 25, in some embodiments the runner base 50 includes the ground anchor 52 similar to the ground anchor 72 of the fielder base 50 (in such embodiments, the ground anchor 72 of the fielder base 70 may be considered a first ground anchor 70, and the ground anchor 52 of the runner base 50 may be considered a second ground anchor 52). As shown with additional reference to FIGS. 2 and 6, the first plate 12 may include an anchor aperture 28, and the second plate 13 may include an anchor aperture 44 corresponding to and aligned with the anchor aperture 28 (in such embodiments, the anchor aperture 20 of the first plate may be considered a first anchor aperture 20, the anchor aperture 28 of the first plate 12 may be considered a second anchor aperture 28, and the anchor aperture 44 of the second plate 13 may be considered a third anchor aperture 44). In such embodiments, similar to the fashion in which the first ground anchor 72 of the fielder base 70 may be received by the first anchor aperture 20 of the first plate, the second ground anchor 52 of the runner base 50 may be received by the second anchor aperture 28 of the first plate 12 and the third anchor aperture 44 of the second plate 13.

As mentioned above, the first plate may include the one or more teeth 22 (e.g., spikes, narrow posts, fingers, etc.) protruding from the bottom face 38 on the second side 16 (e.g., below the runner base 50). When the apparatus 10 is provided as depicted with reference to FIGS. 23 and 25, the one or more teeth 22 may grip the ground surface 75, further preventing angular rotation of the apparatus 10 when a batter strikes the runner base 50.

As discussed herein regarding the apparatus 10, the present disclosure further provides for related methods of adapting a first base to a double first base having the fielder base 70 and the runner base 50. For example, one such method may include providing the first plate 12, securing the runner base to the second side 16 of the first plate 12, advancing the ground anchor 72 of the fielder base 70 through the anchor aperture 20, and inserting the ground anchor 72 into the ground surface 75.

In the drawings, not all reference numbers are included in each drawing, for the sake of clarity. In addition, positional terms such as "upper," "lower," "side," "top," "bottom," etc. refer to the apparatus when in the orientation shown in the drawing, or as otherwise described. A person of skill in the art will recognize that the apparatus can assume different orientations when in use.

Thus, although there have been described particular embodiments of the present invention of a new and useful DOUBLE FIRST BASE ANCHOR, it is not intended that such references to particular embodiments be construed as limitations upon the scope of this invention.

What is claimed is:

1. An apparatus for adapting a first base to a double first base having a fielder base and a runner base, the apparatus comprising:

a first plate defining a top face, a bottom face, a first side, and a second side, the first plate including an anchor aperture defined on the first side, wherein the anchor aperture is shaped to receive a ground anchor of a fielder base advanced through the anchor aperture, and wherein the second side is configured to be secured to a runner base.

2. The apparatus of claim 1, wherein the anchor aperture is shaped such that the first plate mechanically engages and resists angular movement of the ground anchor relative to the first plate.

3. The apparatus of claim 1, wherein the first plate further includes a first one or more connection apertures defined on the second side, and wherein the first one or more connection apertures are shaped to receive a first one or more fastening elements, the first one or more fastening elements configured to mechanically engage the runner base.

4. The apparatus of claim 3, wherein the first one or more connection apertures are distributed in a square pattern.

5. The apparatus of claim 3, wherein the first plate further includes a second one or more connection apertures defined on the first side, and wherein the second one or more connection apertures are shaped to receive a second one or more fastening elements, the second one or more fastening elements configured to mechanically engage the fielder base.

6. The apparatus of claim 1, wherein the first plate further includes one or more teeth protruding from the bottom face on the second side.

7. An apparatus for adapting a first base to a double first base having a fielder base and a runner base, the apparatus comprising:

a first plate defining a top face, a bottom face, a first side, and a second side, the first plate including an anchor aperture defined on the first side; and a runner base disposed above and secured to the second side, wherein the anchor aperture is shaped to receive a ground anchor of a fielder base advanced through the anchor aperture.

8. The apparatus of claim 7, further comprising a second plate disposed between the first plate and the runner base, the second plate secured to the second side of the first plate and the runner base.

9. The apparatus of claim 7, wherein the anchor aperture is shaped such that the first plate mechanically engages and resists angular movement of the ground anchor relative to the first plate.

10. The apparatus of claim 7, wherein the first plate further includes a first one or more connection apertures defined on the second side, and wherein the first one or more connection apertures are shaped to receive a first one or more fastening elements, the first one or more fastening elements configured to mechanically engage the runner base, such that the first plate is secured to the runner base.

11. The apparatus of claim 10, wherein the first one or more connection apertures of the first plate are distributed in a square pattern.

12. The apparatus of claim 11, wherein the first plate further includes a second one or more connection apertures defined on the first side, and wherein the second one or more connection apertures are shaped to receive a second one or more fastening elements, the second one or more fastening elements configured to mechanically engage the fielder base, such that the first plat is secured to a fielder base.

13. The apparatus of claim 12, wherein the second one or more connection apertures are slots.

14. The apparatus of claim 7, wherein the first plate further includes one or more teeth protruding from the bottom face on the second side.

15. The apparatus of claim 7, wherein the anchor aperture is shaped such that the first plate mechanically engages and resists angular movement of the ground anchor relative to the first plate.

16. A method of adapting a first base to a double first base having a fielder base and a runner base, the method comprising:

providing a first plate defining a top face, a bottom face, a first side, and a second side, the first plate including an anchor aperture defined on and vertically extending through the first side;

securing a runner base to the second side;

advancing a ground anchor of a first base through the anchor aperture; and inserting the ground anchor into a ground surface.

17. The method of claim 16, wherein the anchor aperture is shaped such that the first plate mechanically engages and resists angular movement of the ground anchor relative to the first plate.

18. The method of claim 16, wherein securing the runner base to the second side of the first plate includes:

securing a second plate to the second side; and securing the second plate to the runner base.

19. The method of claim 16, wherein securing the runner base to the second side further includes:

advancing a first one or more fastening elements through a first one or more connection apertures defined on the second side of the first plate; and mechanically engaging the runner base with the one or more fastening elements.

20. The method of claim 16, wherein the first plate further includes one or more teeth protruding from the bottom face on the second side.

21. An apparatus, comprising:

a fielder base including an anchor post;

a flat adapter plate disposed below the fielder base, the adapter plate having a first side positioned under the fielder base and a second side extending away from the fielder base;

an anchor aperture defined through the first side of the adapter plate, wherein the anchor post extends downwardly from the fielder base through the anchor aperture; and a runner base disposed on the second side of the adapter plate beside the fielder base.

22. The apparatus of claim 21, wherein the anchor post extending downwardly through the anchor aperture includes a rectangular cross-sectional profile, and the anchor aperture defines a corresponding rectangular cross-sectional profile such that the adapter plate mechanically engages the anchor post.

23. The apparatus of claim 22, wherein the engagement between the anchor post and the adapter plate via the anchor aperture resists angular movement of the adapter plate relative to the anchor post when the adapter plate is attached to the anchor post.

24. The apparatus of claim 23, wherein the adapter plate further comprises a plurality of spikes extending downwardly from the second side of the adapter plate below the runner base.

25. The apparatus of claim 24, further comprising a concrete base having an anchor sleeve disposed below the fielder base, wherein the anchor post extends downwardly from the fielder base through the anchor aperture of the adapter plate and engages the anchor sleeve.

* * * * *